US007422843B2

(12) United States Patent
Soejima et al.

(10) Patent No.: US 7,422,843 B2
(45) Date of Patent: Sep. 9, 2008

(54) SILVER HALIDE COLOR PHOTOGRAPHIC LIGHT-SENSITIVE MATERIAL

(75) Inventors: Shin Soejima, Minami-ashigara (JP); Hidekazu Sakai, Minami-ashigara (JP); Shinji Tanaka, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/727,249

(22) Filed: Mar. 26, 2007

(65) Prior Publication Data

US 2007/0248906 A1 Oct. 25, 2007

(30) Foreign Application Priority Data

Mar. 27, 2006 (JP) ..... 2006-085239

(51) Int. Cl.

| | |
|---|---|
| ***G03C 1/46*** | (2006.01) |
| ***G03C 1/85*** | (2006.01) |
| ***G03C 1/76*** | (2006.01) |
| ***G03C 1/06*** | (2006.01) |
| ***G03C 1/815*** | (2006.01) |

(52) U.S. Cl. ..... 430/502; 430/503; 430/517; 430/523; 430/527; 430/530; 430/934

(58) Field of Classification Search ..... 430/502, 430/503, 517, 523, 527, 530, 934
See application file for complete search history.

(56) References Cited

U.S. PATENT DOCUMENTS

| | | | | |
|---|---|---|---|---|
| 4,294,916 | A | 10/1981 | Postle et al. | |
| 4,294,917 | A | 10/1981 | Postle et al. | |
| 6,060,228 | A * | 5/2000 | Suzuki | 430/522 |
| 6,756,190 | B2 * | 6/2004 | Sakai | 430/507 |
| 6,852,478 | B2 * | 2/2005 | Sakai et al. | 430/503 |

FOREIGN PATENT DOCUMENTS

| | | |
|---|---|---|
| EP | 0 015 601 B1 | 5/1983 |
| EP | 0 252 550 A1 | 1/1988 |
| EP | 0 274 723 A1 | 7/1988 |
| EP | 0 276 566 A1 | 8/1988 |
| JP | 55-92716 | 7/1980 |
| JP | 55-155350 | 12/1980 |
| JP | 55-155351 | 12/1980 |
| JP | 63-27838 | 2/1988 |
| JP | 63-197943 | 8/1988 |
| JP | 64-40827 | 2/1989 |
| JP | 2-282244 | 11/1990 |
| JP | 8-36239 | 2/1996 |
| JP | 10-62905 | 3/1998 |
| JP | 11-95371 | 4/1999 |
| JP | 2002-144493 | 5/2002 |
| WO | WO 88/04794 | 6/1988 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material for movie, containing, on a side of a transmission-type support, yellow-, cyan- and magenta-color-forming light-sensitive silver halide emulsion layers and a non-light-sensitive hydrophilic colloidal layer, in which the non-light-sensitive hydrophilic colloidal layer contains a solid fine-particle dispersion of a specific dye; and in which a surface resistance value of a surface of the material opposite to the side where the silver halide emulsion layers are provided, satisfies expression (S) and expression (T) described below:

$$0.3 \leqq (SR2 - SR1) \leqq 3.0 \quad \text{Expression (S)}$$

$$9.0 \leqq SR1 \leqq 12.7$$

wherein SR1 and SR2 represent each of the logarithm of the surface resistance values before and after the material is subjected to a color developing treatment.

8 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material excellent in storability and uniformity for quality when it is processed at a laboratory. In particular, the present invention relates to a silver halide color photographic light-sensitive material for movie.

BACKGROUND OF THE INVENTION

In a movie, which is an application of silver halide photographic technique, subjects are photographed usually at a rate of 24 photographs per second, and then the resultant static images are projected on a screen successively at the same rate as that of photographing, thereby reproducing moving images on the screen. This method is based on silver halide photographic technique that continues to be improved over 100 years or more, and this method gives much higher quality for moving images than those of any other method for reproducing the images. Further, because the images can be enlarged in a screen with ease by virtue of this high quality of images, the method is suitable for appreciation of moving-images by a great number of people simultaneously. Therefore, a large number of theaters are established that have facilities for projecting pictures onto a large screen which allows a large number of people to appreciate the picture: a movie theater. However, for all processes from photographing through edition to screening, recently rapid developments of electronic technique and information processing technique are proposed as alternative means, which means can give quality for images that is equivalent to the conventional method, by utilizing digital image processing techniques. These means based on the digital image processing technique are characterized in that images can be easily handled though the progress of computers and good reproducibility can be attained on the basis of the characteristic of digital signals that are hardly deteriorated. Accordingly, for the movie based on silver halide photographic technique also, desired is acquisition of easiness or stability at processing laboratories while original quality is kept high. In particular, stability against storage or fluctuations of a developing solution is desired.

One important property out of photographic properties is the change of density of the white portion in a developed image, when a photograph is stored or a developing solution fluctuates.

Hitherto, a countermeasure against the fluctuation in the density of the white portion has been taken up as an important problem to be solved. The problem has been investigated mainly from the following viewpoints:

(1) Promotion of an outflow of a sensitizing dye and a dye at a washing step for preventing halation or irradiation for the purpose of promoting removal of unnecessary coloring ingredients, and (2) Search for compounds which have good influence on a light-sensitive silver halide emulsion and restrain fogging.

Regarding light-sensitive materials for movie-photographs, which are enlarged and projected on a screen for appreciation, sharpness of an image is an important requirement for image quality. In order to improve the sharpness, it is effective to use the above-described dye for preventing halation or irradiation. Therefore, proposed are various water-soluble dyes for preventing irradiation as described in, for example, JP-A-2-282244 ("JP-A" means unexamined published Japanese patent application), and various halation-preventing methods based on a dye-fixing manner as described in, for example, JP-A-11-95371, JP-A-55-155350, JP-A-55-155351, JP-A-55-92716, JP-A-63-197943, JP-A-63-27838, JP-A-64-40827, EP 15601 B1, EP 276566 A1, and WO 8/04794. However, any one of those is insufficient in order to prevent a white portion from fluctuation of density.

In particular, JP-A-2-282244 and JP-A-11-95371 each propose a dye which is dispersed, in a solid dispersion state, in a hydrophilic colloidal layer to remain in the layer and is easily removed by development in order to aim compatibility between prevention of a fluctuation of density of the white portion and halation-prevention based on the fix of dyes. However, the dye is insufficient for preventing the white portion from density fluctuation, in particular the density fluctuation after a long-time storage.

In general, silver halide photographic light-sensitive materials are each produced by forming a light-sensitive silver halide photographic emulsion layer (silver halide photographic light-sensitive layer), an antihalation layer, a protective layer, an intermediate layer, an undercoating layer, an antistatic layer, and so forth on an electrically insulating substrate, such as a plastic film.

In recent years, technique for producing silver halide color photographic light-sensitive materials has been remarkably improved; thus, a rise in the printing speed of images has been advancing. With this rise in the printing speed, there arises a new problem that powder drops or printing dust is generated in each step in the production process. Against the problem, disclosed are a method of specifying a hardening agent used in the antistatic layer, a method of specifying a structure of metal oxide particles as an antistatic agent, and a method of specifying a surface resistance value before and after development (see, for example, JP-A-8-36239, JP-A-2002-144493, and JP-A-10-62905).

However, when a higher-speed exposure is carried out to make the productivity higher, static electricity may be generated. Thus, a new improving technique has been required.

SUMMARY OF THE INVENTION

The present invention resides in a silver halide color photographic light-sensitive material for movie, comprising, on a side of a transmission-type support, at least one yellow-color-forming light-sensitive silver halide emulsion layer, at least one cyan-color-forming light-sensitive silver halide emulsion layer, at least one magenta-color-forming light-sensitive silver halide emulsion layer and at least one non-light-sensitive hydrophilic colloidal layer, wherein the non-light-sensitive hydrophilic colloidal layer comprises a solid fine-particle dispersion of a dye represented by formula (I) shown below; and wherein a surface resistance value of a surface of the material opposite to the side where the silver halide emulsion layers are provided, satisfies expression (S) and expression (T) described below:

$$D-(X)_y \qquad \text{Formula (I)}$$

wherein, in formula (I), D represents a group to give a compound having a chromophore, X represents a dissociable hydrogen or a group having a dissociable hydrogen, and y represents an integer of 1 to 7; and $$0.3 \leqq (SR2-SR1) \leqq 3.0 \qquad \text{Expression (S)}$$

$$9.0 \leqq SR1 \leqq 12.7 \qquad \text{Expression (T)}$$

wherein, in expression (S) and expression (T), SR1 represents the logarithm of the surface resistance value R1 before the material is subjected to a color developing treatment, and SR2 represents the logarithm of the surface resistance value R2 after the material is subjected to the color developing treatment.

Other and further features and advantages of the invention will appear more fully from the following description.

DETAILED DESCRIPTION OF THE INVENTION

The inventors have made eager investigations about the above-mentioned problems, so as to find out that it is effective to use a specific dye and further use a specific ammonium salt in order to keep certain uniformity for finished photograph at a laboratory where processing is conducted, in particular stability of density of white portions regardless of a storage time of the material. The inventors have further found out that the static fogging resistance of the material, at the time of exposing the material to light at a high speed and transporting the material, is further improved by applying them to a support surface of the material which is opposite to an emulsion layer surface of the support. Thus, the invention has been made based on these findings.

According to the present invention, there is provided the following means:

(1) A silver halide color photographic light-sensitive material for movie, comprising, on a side of a transmission-type support, at least one yellow-color-forming light-sensitive silver halide emulsion layer, at least one cyan-color-forming light-sensitive silver halide emulsion layer, at least one magenta-color-forming light-sensitive silver halide emulsion layer and at least one non-light-sensitive hydrophilic colloidal layer, wherein the non-light-sensitive hydrophilic colloidal layer comprises a solid fine-particle dispersion of a dye represented by formula (I) shown below; and wherein a surface resistance value of a surface of the material opposite to the side where the silver halide emulsion layers are provided, satisfies expression (S) and expression (T) described below:

$$D-(X)_y \qquad \text{Formula (I)}$$

wherein, in formula (I), D represents a group to give a compound having a chromophore, X represents a dissociable hydrogen or a group having a dissociable hydrogen, and y represents an integer of 1 to 7; and $$0.3 \leqq (SR2-SR1) \leqq 3.0 \qquad \text{Expression (S)}$$

$$9.0 \leqq SR1 \leqq 12.7 \qquad \text{Expression (T)}$$

wherein, in expression (S) and expression (T), SR1 represents the logarithm of the surface resistance value R1 before the material is subjected to a color developing treatment, and SR2 represents the logarithm of the surface resistance value R2 after the material is subjected to the color developing treatment;

(2) The silver halide color photographic light-sensitive material for movie according to the above item (1), wherein at least one layer provided on a surface of the support opposite to the side where the silver halide emulsion layers are provided comprises a compound represented by formula (AS) shown below:

Formula (AS)

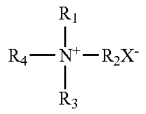

wherein $R_1$ to $R_4$ each independently represent an alkyl group having 1 to 4 carbon atoms, and $X^-$ represents a halogen or a hydroxyl group;

(3) The silver halide color photographic light-sensitive material for movie according to the above item (1) or (2), wherein the transparent support is a polyester support; and wherein an electroconductive antistatic layer and a protective layer are provided, in this order, on a surface of the support opposite to the side where the silver halide emulsion layers are provided;

(4) The silver halide color photographic light-sensitive material for movie according to the above item (3), wherein the electroconductive antistatic layer comprises metal oxide particles; and wherein the metal oxide particles are made of at least one metal oxide selected from the group consisting of ZnO, $TiO_2$, $SnO_2$, $Al_2O_3$, $In_2O_3$, MgO, complex metal oxides of there metal oxides, and metal oxides containing at least one of these metal oxides and a different atom; and (5) The silver halide color photographic light-sensitive material for movie according to the above item (4), wherein the content of the metal oxide particles in the antistatic layer is from 50 mg/$M^2$ to 500 mg/$m^2$.

The silver halide color photographic light-sensitive material of the present invention will be hereinafter explained in detail.

First, the compound represented by the formula (I) will be explained in detail.

$$D-(X)_y \qquad \text{Formula (I)}$$

In the formula (I), D represents a group to give a compound having a chromophore, X represents a dissociable hydrogen or a group having a dissociable hydrogen, and y denotes an integer from 1 to 7. Here, when y is an integer from 2 to 7, Xs may be the same or different from each other.

The dye represented by formula (I) is characterized by the point that it has a dissociable hydrogen in its molecular structure. The group to give a compound having a chromophore (D) may be selected from many well-known dyes. Examples of the compound include oxonol dyes, merocyanine dyes, cyanine dyes, allylidene dyes, azomethine dyes, triphenylmethane dyes, azo dyes, anthraquinone dyes and indoaniline dyes.

X represents a dissociable hydrogen or a group having a dissociable hydrogen which is bonded to D directly or through a divalent linking group.

The divalent linking group disposed between X and D is a divalent group including an alkylene group, allylene group, heterocyclic residue, —CO—, —$SO_n$— (n=0, 1 or 2), —NR'— (R' represents a hydrogen atom, an alkyl group or an aryl group) and —O— and combinations of these linking groups. Further, these groups may have a substituent, such as an alkyl group, aryl group, alkoxy group, amino group, acylamino group, halogen atom, hydroxyl group, carboxy group, sulfamoyl group, carbamoyl group or sulfonamido group.

Given as preferable examples of the divalent connecting group are —$(CH_2)_n$— (n'=1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociable hydrogen or the group having a dissociable hydrogen represented by X is non-dissociable and has such characteristics that it makes the dye represented by the formula (I) substantially water-insoluble, in such a condition that the dye represented by the above formula (I) is added in the silver halide photographic light-sensitive material of the present invention. In a step of developing the light-sensitive material, the hydrogen or group represented by X has also such characteristics that it dissociates and makes the dye represented by the formula (I) substantially water-soluble. Given as examples of the group having a dissociable hydrogen represented by X are groups having a carboxylic acid group, sulfonamido group, sulfamoyl group, sulfonylcarbamoyl group, acylsulfamoyl group or phenolic hydroxyl group. Examples of the dissociable hydrogen represented by X include hydrogen of an enol group of an oxonoldye.

A preferable range of y is from 1 to 5 and particularly preferably from 1 to 3.

Preferable examples among the compounds represented by the above formula (I) are those in which the group X having a dissociable hydrogen has a carboxylic acid group. Particularly, compounds having an aryl group substituted with a carboxyl group are preferred.

A more preferable one among the dyes represented by the above formula (I) is a compound represented by the following formula (II) or (III).

$$A^1=L^1-(L^2=L^3)_{ml}-Q \qquad \text{Formula (II)}$$

In the formula (II), $A^1$ represents an acidic nucleus, Q represents an aryl group or a heterocyclic group, $L^1$, $L^2$ and $L^3$ respectively represent a methine group, ml denotes 0, 1 or 2, provided that the compound represented by the formula (II) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

$$A^1=L^1-(L^2=L^3)_{n1}-A^2 \qquad \text{Formula (III)}$$

In the formula (III), $A^1$ and $A^2$ respectively represent an acidic nucleus, $L^1$, $L^2$ and $L^3$ respectively represent a methine group, n1 denotes 0, 1, 2 or 3, provided that the compound represented by the formula (III) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

The above formulae (II) and (III) will be hereinafter explained in detail.

The acidic nuclei represented by $A^1$ and $A^2$ are preferably those derived from cyclic ketomethylene compounds or compounds having a methylene group sandwiched between electron attractive groups.

Examples of the above cyclic ketomethylene compound include 2-pyrazoline-5-one, rhodanine, hydantoin, thiohydantoin, 2,4-oxazolidinedione, isooxazolone, barbituric acid, thiobarbituric acid, indandione, dioxopyrazolopyridine, hydroxypyridone, pyrazolidinedione and 2,5-dihydrofuran. These compounds may have a substituent.

The compounds having a methylene group sandwiched by electron attractive groups may be represented by $Z^1CH_2Z^2$. Here, $Z^1$ and $Z^2$ respectively represent —CN, —$SO_2R^{11}$, —$COR^{11}$, —$COOR^{12}$, —$CONHR^{12}$, —$SO_2NHR^{12}$ or —$C[{=}C(CN)_2]R^{11}$. $R^{11}$ represents an alkyl group, an aryl group or a heterocyclic group, and $R^{12}$ represents a hydrogen atom or a group represented by $R^{11}$. These groups each may have be further substituted.

Examples of the aryl group represented by Q include a phenyl group and naphthyl group, which may respectively have a substituent(s). Examples of the heterocyclic group represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxodiazole, benzoquinoline, thiadiazole, pyrrolothiazole, pyrrolopyridazine, tetrazole, oxazole, coumarin and coumarone. These each may have a substituent(s).

The methine group represented by $L^1$, $L^2$ and $L^3$ may have a substituent(s) and these substituents may be connected to each other to form a five- or six-membered ring (e.g., cyclopentene or cyclohexene).

No particular limitation is imposed on the substituent which each of the aforementioned groups may have as far as it does not substantially dissolve the compound represented by any of the above formulae (I) to (III) in water having a pH of 5 to 7. For example, the following substituents are exemplified.

Specifically, examples of the substituent include a carboxylic acid group, a sulfonamido group having 1 to 10 carbon atoms (e.g., methanesulfonamido, benzenesulfonamido, butanesulfonamido and n-octanesulfonamido), an unsubstituted, or alkyl- or aryl-substituted sulfamoyl group having 0 to 10 carbon atoms (e.g., unsubstituted sulfamoyl group, methylsulfamoyl, phenylsulfamoyl, naphthylsulfamoyl and butylsulfamoyl), a sulfonylcarbamoyl group having 2 to 10 carbon atoms (e.g., methanesulfonylcarbamoyl, propanesulfonylcarbamoyl and benzenesulfonylcarbamoyl), an acylsulfamoyl group having 1 to 10 carbon atoms (e.g., acetylsulfamoyl, propionylsulfamoyl, pivaloylsulfamoyl and benzoylsulfamoyl), a chain or cyclic alkyl group having 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenetyl, 4-carboxybenzyl, and 2-diethylaminoethyl), an alkenyl group having 2 to 8 carbon atoms (e.g., vinyl and allyl), an alkoxy group having 1 to 8 carbon atoms (e.g., methoxy, ethoxy and butoxy), a halogen atom (e.g., F, Cl and Br), an amino group having 0 to 10 carbon atoms (e.g., unsubstituted amino, dimethylamino, diethylamino and carboxyethylamino), an ester group having 2 to 10 carbon atoms (e.g., methoxycarbonyl), an amido group having 1 to 10 carbon atoms (e.g., acetylamino and benzamido), a carbamoyl group having an amido group having 1 to 10 carbon atoms (e.g., acetylamino and benzamido), a carbamoyl group having having 6 to 10 carbon atoms (e.g., phenyl, naphthyl, hydroxyphenyl, 4-carboxyphenyl, 3-carboxyphenyl, 3,5-dicarboxyphenyl, 4-methanesulfonamidophenyl and 4-butanesulfonamidophenyl), an aryloxy group having 6 to 10 carbon atoms (e.g., phenoxy, 4-carboxyphenoxy, 3-methylphenoxy and naphthoxy), an alkylthio group having 1 to 8 carbon atoms (e.g., methylthio, ethylthio and octylthio), an arylthio group having 6 to 10 carbon atoms (e.g., phenylthio and naphthylthio), an acyl group having 1 to 10 carbon atoms (e.g., acetyl, benzoyl and propanoyl), a sulfonyl group having 1 to 10 carbon atoms (e.g., methanesulfonyl and benzenesulfonyl), a ureido group having 1 to 10 carbon atoms (e.g., ureido and methylureido), a urethane group having 2 to 10 carbon atoms (e.g., methoxycarbonylamino and ethoxycarbonylamino), a cyano group, a hydroxyl group, a nitro group, and a heterocyclic group (e.g., 5-carboxybenzooxazole ring, pyridine ring, sulfolane ring, pyrrole ring, pyrrolidine ring, morpholine ring, piperazine ring, pyrimidine ring and furan ring).

More preferable examples among the compounds represented by the above formula (III) are compounds represented by the following formula (IV). The compound represented by the formula (IV) has hydrogen of an enol group as a dissociable hydrogen.

Formula (IV)

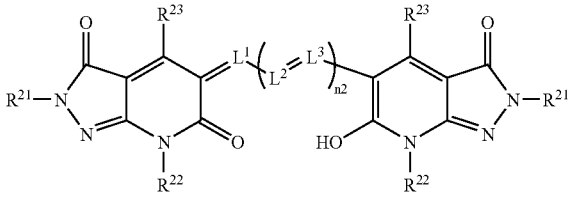

In the formula (IV), $R^{21}$ represents a hydrogen atom, an alkyl group, an aryl group or a heterocyclic group, $R^{22}$ represents a hydrogen atom, an alkyl group, an aryl group, a heterocyclic group, —$COR^{24}$ or $SO_2R^{24}$, $R^{23}$ represents a hydrogen atom, a cyano group, a hydroxyl group, a carboxyl group, an alkyl group, an aryl group, —$CO_2R^{24}$, —$OR^{24}$, —$NR^{25}R^{26}$, —$CONR^{25}R^{26}$, —$NR^{25}COR^{24}$, —$NR^{25}SO_2R^{24}$ or —$NR^{25}CONR^{25}R^{26}$ (in which $R^{24}$ represents an alkyl group or an aryl group, and $R^{25}$ and $R^{26}$ respectively represent a hydrogen atom, an alkyl group or an aryl group), $L^1$, $L^2$ and $L^3$ respectively represent a methine group, and n2 denotes 1 or 2.

In the above formula (IV), examples of the alkyl group as $R^{21}$ include an alkyl group having 1 to 4 carbon atoms, 2-cyanoethyl group, 2-hydroxyethyl group and carboxybenzyl group. Examples of the aryl group as $R^{21}$ include a phenyl group, 2-methylphenyl group, 2-carboxyphenyl group, 3-carboxyphenyl group, 4-carboxyphenyl group, 3,6-dicarboxyphenyl group, 2-hydroxyphenyl group, 3-hydroxyphenyl group, 4-hydroxyphenyl group, 2-chloro-4-carboxyphenyl group and 4-methylsulfamoylphenyl group. Examples of the heterocyclic group as $R^{21}$ include 5-carboxybenzooxazole-2-yl group.

Examples of the alkyl group as $R^{22}$ include an alkyl group having 1 to 4 carbon atoms, carboxymethyl group, 2-hydroxyethyl group and 2-methoxyethyl group. Examples of the aryl group as $R^{22}$ include a 2-carboxyphenyl group, 3-carboxyphenyl group, 4-carboxyphenyl group and 3,6-dicarboxyphenyl group. Examples of the heterocyclic group as $R^{22}$ include a pyridyl group. Examples of —$COR^{24}$ as $R^{22}$ include an acetyl group, and examples of —$SO_2R^{24}$ as $R^{22}$ include a methanesulfonyl group.

Given as examples of the alkyl group as $R^{23}$, $R^{24}$, $R^{25}$ or $R^{26}$ are alkyl groups having 1 to 4 carbon atoms. Given as examples of the aryl group as $R^{23}$, $R^{24}$, $R^{25}$ or $R^{26}$ are a phenyl group and a methylphenyl group.

In the present invention, $R^{21}$ is preferably a phenyl group substituted with a carboxyl group (e.g., 2-carboxyphenyl, 3-carboxyphenyl, 4-carboxyphenyl and 3,6-dicarboxyphenyl).

Specific examples of the compounds represented by any one of the above formulae (I) to (IV) are shown below, which, however, are not intended to be limiting of the present invention.

(I-1)

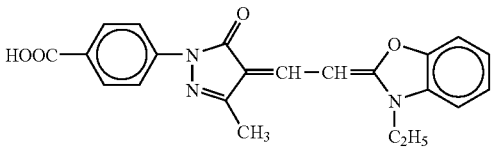

(I-2)

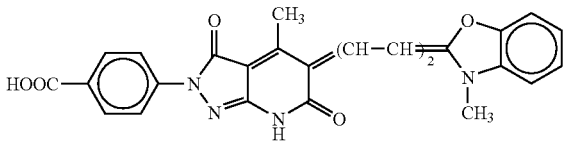

(I-3)

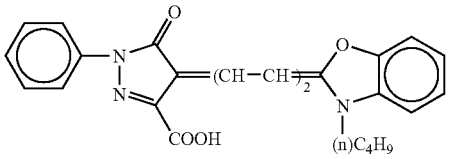

(I-4)

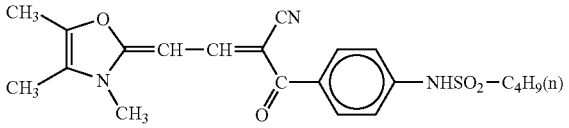

(I-5)

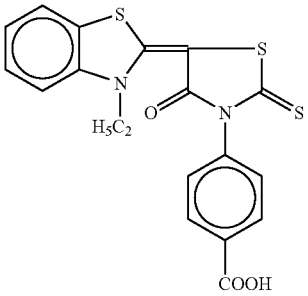

(I-6)

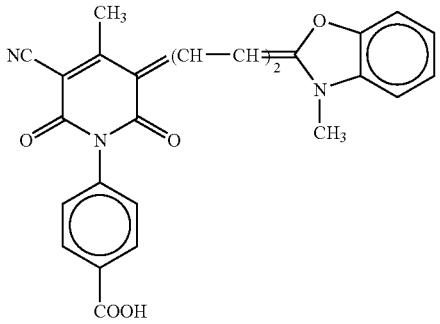

-continued
(I-7)
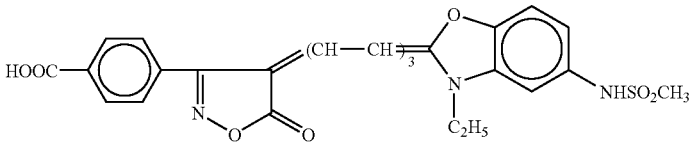
(I-8)
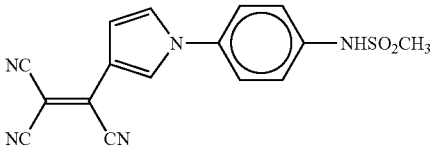
(I-9)
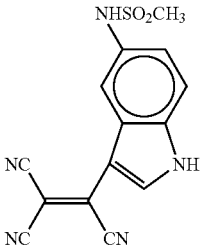
(I-10)
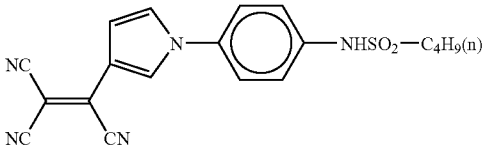
(I-11)
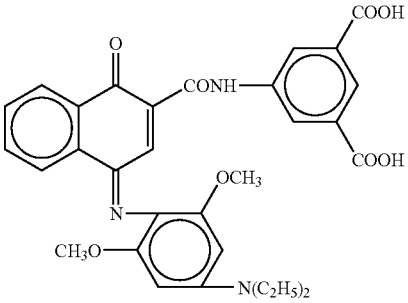
(I-12)
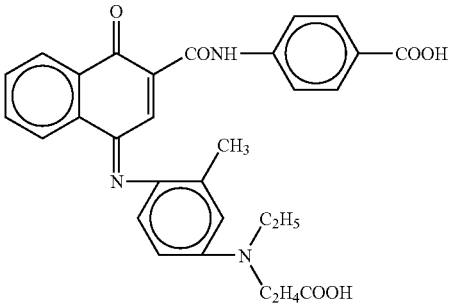
(I-13)
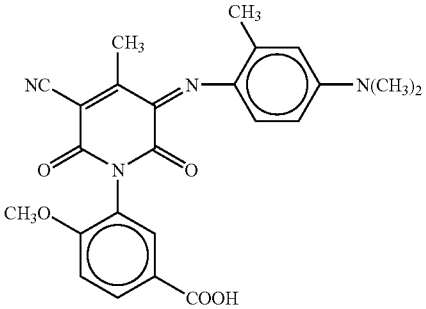
(I-14)
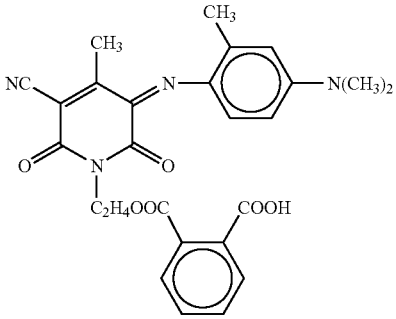
(II-1)
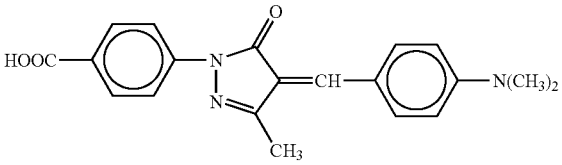
(II-2)
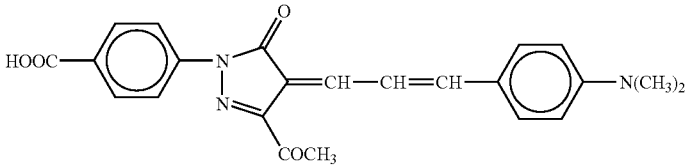

-continued
(II-3)
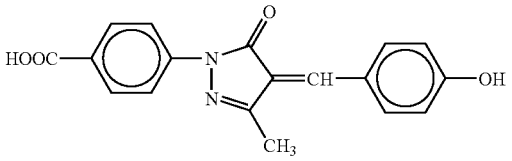
(II-4)
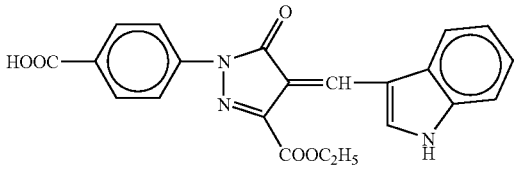
(II-5)
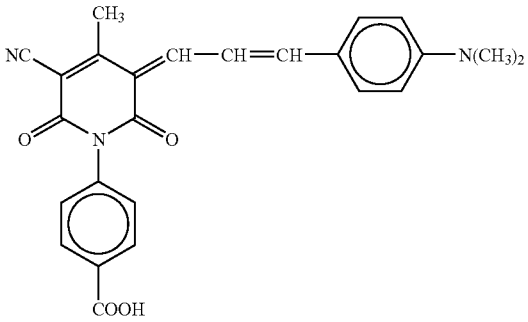
(II-6)
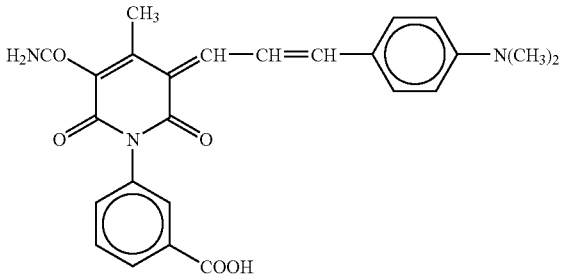
(II-7)
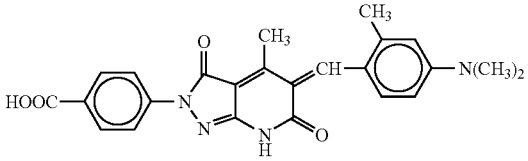
(II-8)
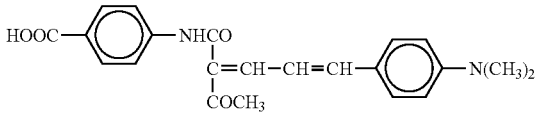
(II-9)
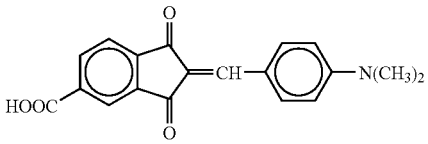
(II-10)
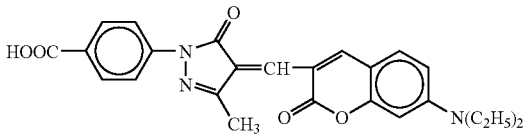
(II-11)
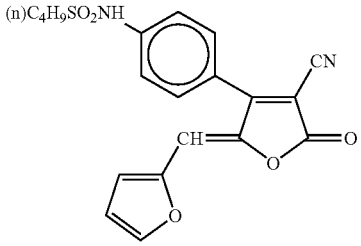
(II-12)
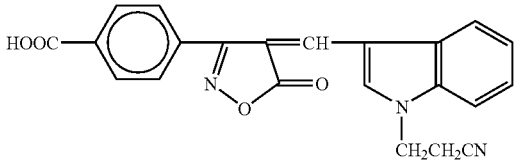
(II-13)
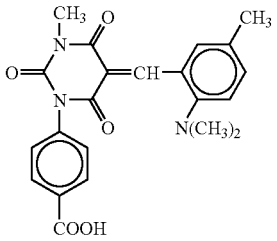
(II-14)
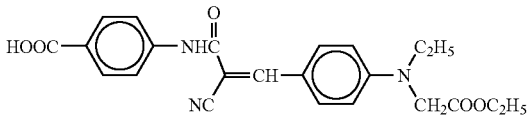
(II-15)
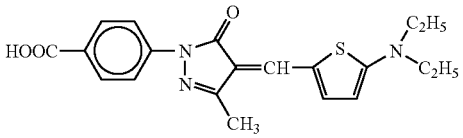
(II-16)
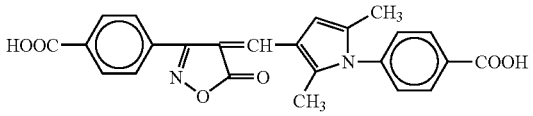

-continued
(II-17)
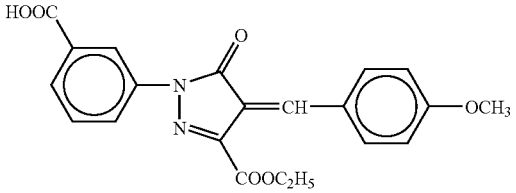
(II-18)
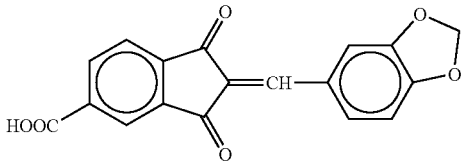
(II-19)
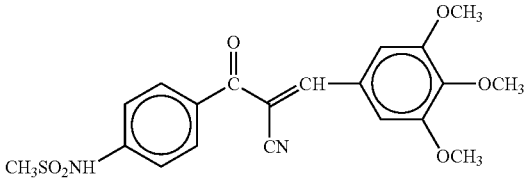
(II-20)
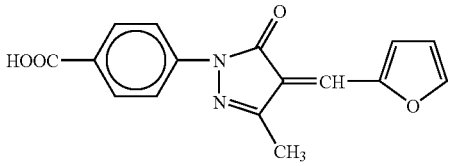
(II-21)
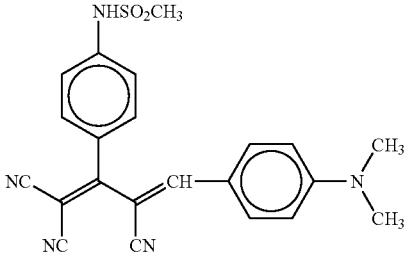
(II-22)
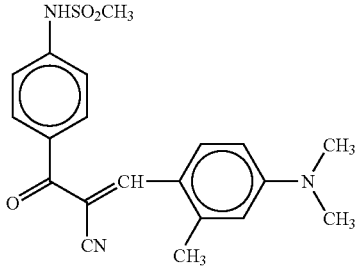
(II-23)
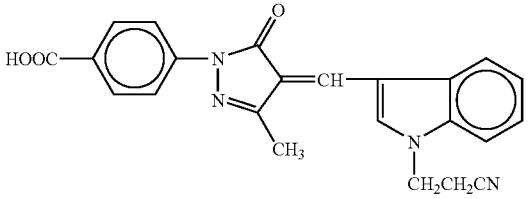
(II-24)
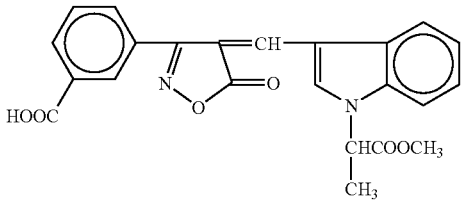
(II-25)
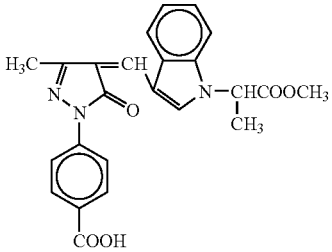
(III-1)
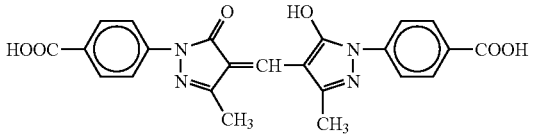
(III-2)
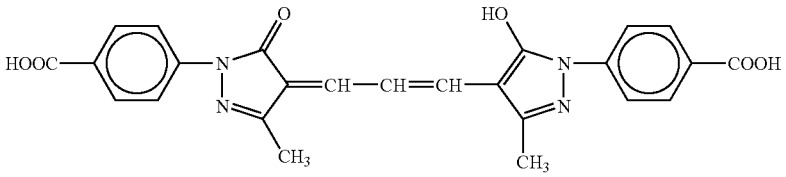
(III-3)
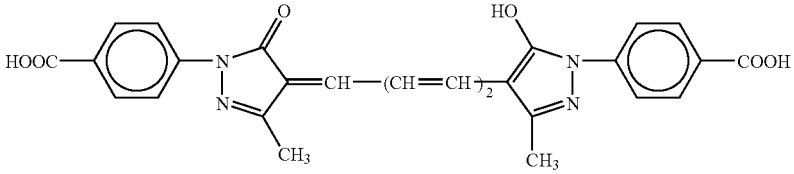

-continued
(III-4)
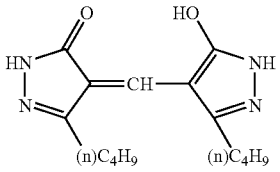
(III-5)
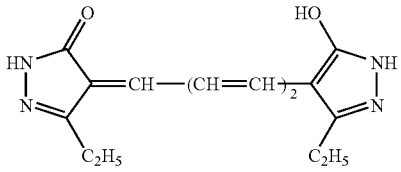
(III-6)
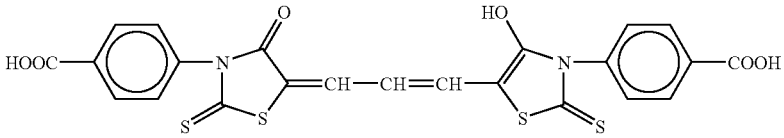
(III-7)
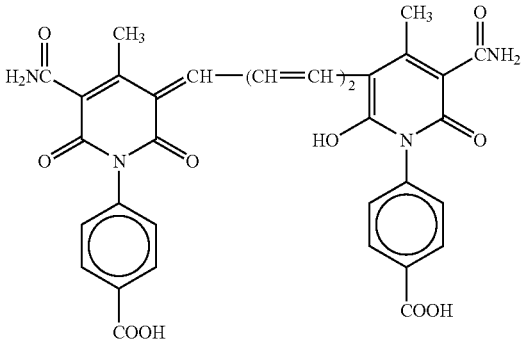
(III-8)
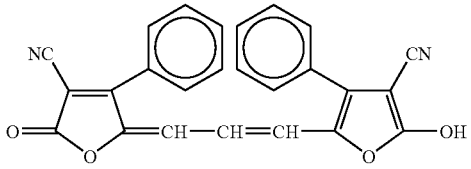
(III-9)
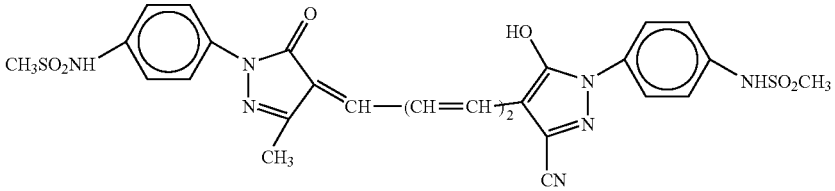
(III-10)
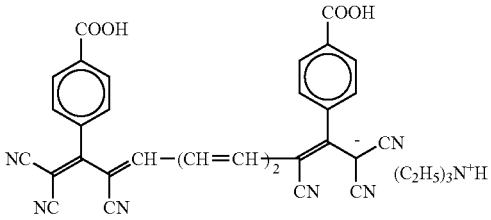
(III-11)
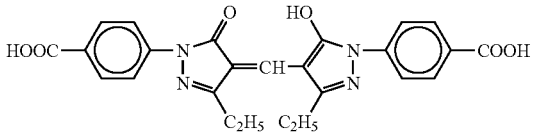
(III-12)
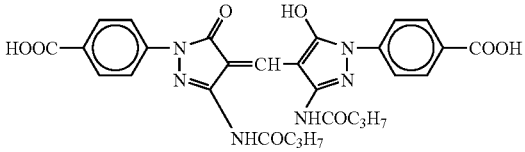
(III-13)
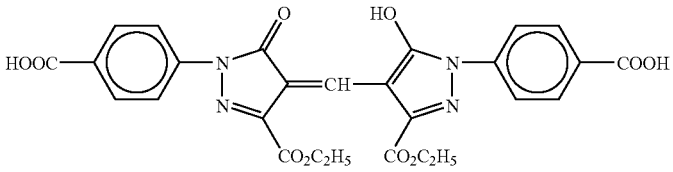

-continued
(III-14)
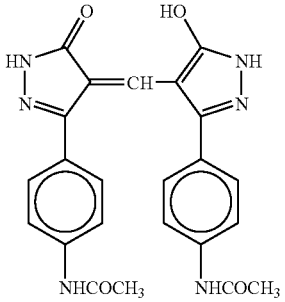
(III-15)
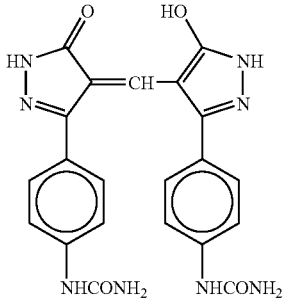
(III-16)
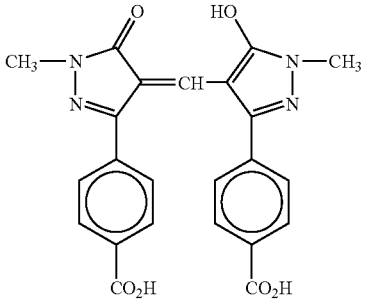
(III-17)
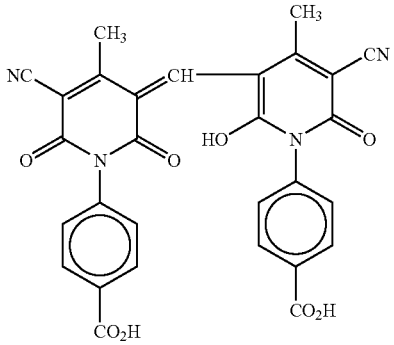
(III-18)
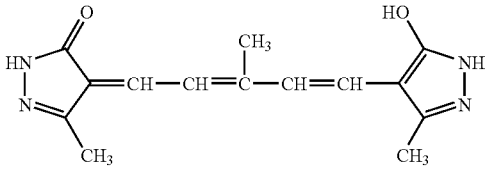
(III-19)
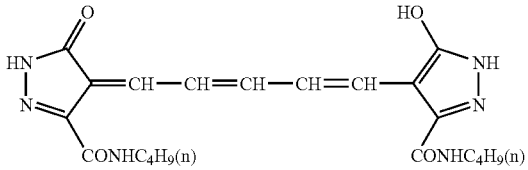
(III-20)
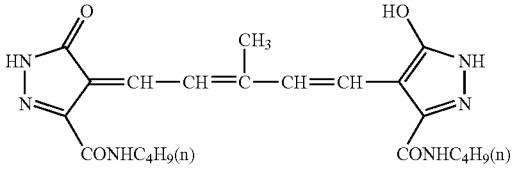
(III-21)
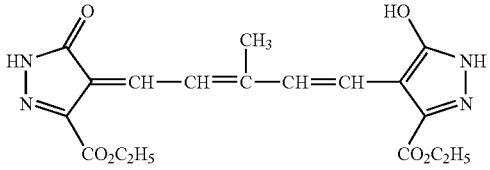
(III-22)
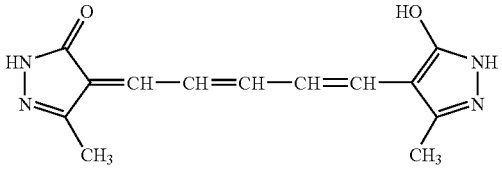
(III-23)
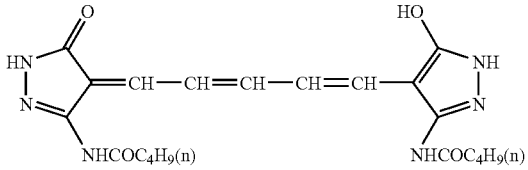
(III-24)
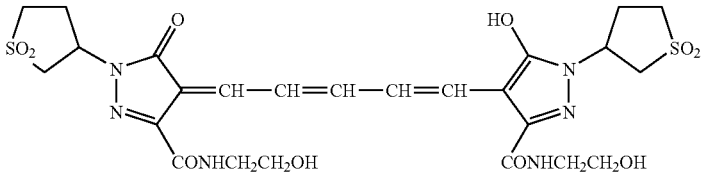

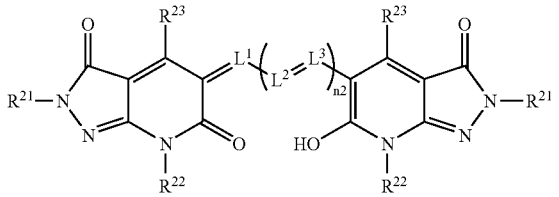
| | $R^{21}$ | $R^{22}$ | $R^{23}$ | $=L^1-(L^2=L^3)_{n2}-$ |
|---|---|---|---|---|
| IV-1 | 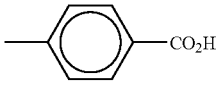 | —H | $-CH_3$ | =CH—CH=CH— |
| IV-2 | 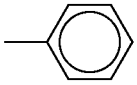 | —H | $-CH_3$ | =CH—CH=CH— |
| IV-3 | $-CH_3$ | —H | $-CH_3$ | =CH—CH=CH— |
| IV-4 | 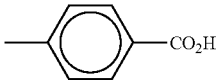 | $-CH_3$ | $-CH_3$ | =CH—CH=CH— |
| IV-5 | 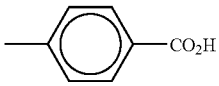 | 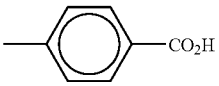 | $-CH_3$ | =CH—CH=CH— |
| IV-6 | 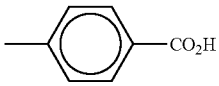 | $-CH_3$ | $-CO_2C_2H_5$ | =CH—CH=CH— |
| IV-7 | 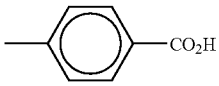 | $-CH_3$ | $-CO_2H$ | =CH—CH=CH— |
| IV-8 | $-CH_3$ | 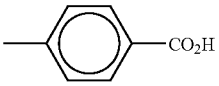 | $-CH_3$ | =CH—CH=CH— |
| IV-9 | $-CH_3$ | 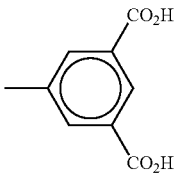 | $-CH_3$ | =CH—CH=CH— |
| IV-10 | $-CH_3$ | $-CH_3$ | $-CH_3$ | =CH—CH=CH— |
| IV-11 | 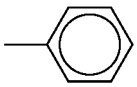 | 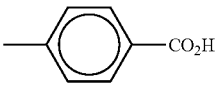 | $-CH_3$ | =CH—CH=CH— |
| IV-12 | 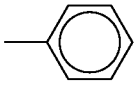 | 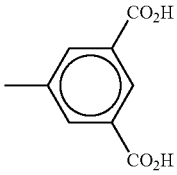 | $-CH_3$ | =CH—CH=CH— |

-continued
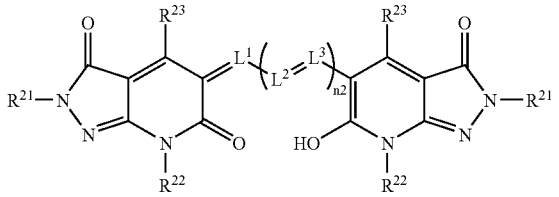
| | $R^{21}$ | $R^{22}$ | $R^{23}$ | $=L^1-(L^2=L^3)_{n2}-$ |
|---|---|---|---|---|
| IV-13 | 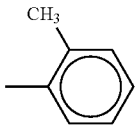 | 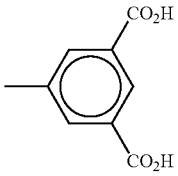 | $-CH_3$ | $=CH-CH=CH-$ |
| IV-14 | 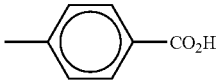 | $-H$ | $-CH_3$ | 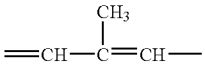 |
| IV-15 | 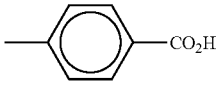 | $-H$ | $-CO_2C_2H_5$ | $=CH-CH=CH-$ |
| IV-16 | 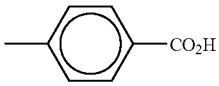 | $-H$ | $-CO_2H$ | $=CH-CH=CH-$ |
| IV-17 | 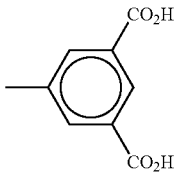 | $-H$ | $-CH_3$ | $=CH-CH=CH-$ |
| IV-18 | 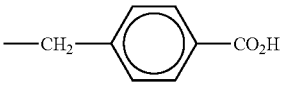 | $-H$ | $-CH_3$ | 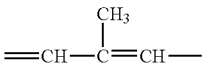 |
| IV-19 | 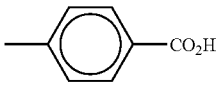 | $-CH_2CH_2OH$ | $-H$ | $=CH-CH=CH-$ |
| IV-20 | 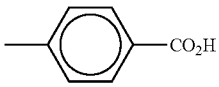 | $-CH_2CO_2H$ | $-CH_3$ | 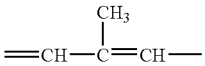 |
| IV-21 | 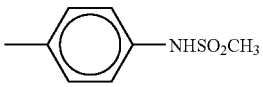 | $-H$ | $-CH_3$ | $=CH-CH=CH-$ |
| IV-22 | 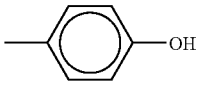 | $-H$ | $-CH_3$ | $=CH-CH=CH-$ |
| IV-23 | $-CH_2CH_2OH$ | $-H$ | $-CH_3$ | $=CH-CH=CH-$ |
| IV-24 | $-CH_3$ | $-CH_2CH_2OH$ | $-CH_3$ | $=CH-CH=CH-$ |
| IV-25 | $-H$ | 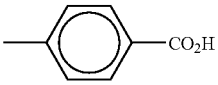 | $-CH_3$ | $=CH-CH=CH-$ |

-continued
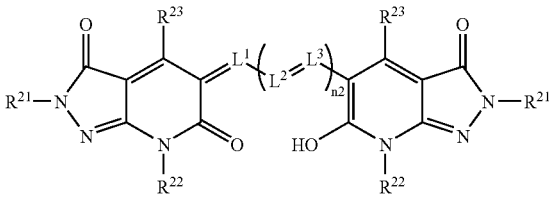
| | $R^{21}$ | $R^{22}$ | $R^{23}$ | $=L^1-(L^2=L^3)_{n2}-$ |
|---|---|---|---|---|
| IV-26 | —H | —H | $-CO_2H$ | =CH—CH=CH— |
| IV-27 | 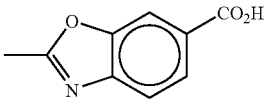 | —H | $-C_2H_5$ | =CH—CH=CH— |
| IV-28 | 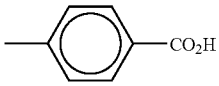 | $-SO_2CH_3$ | $-CO_2CH_3$ | 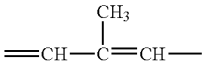 |
| IV-29 | 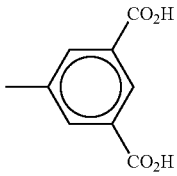 | $-COCH_3$ | $-CH_3$ | =CH—CH=CH— |
| IV-30 | —H | 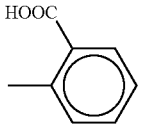 | $-CH_3$ | =CH—CH=CH— |
| IV-31 | 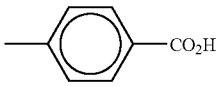 | 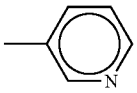 | $-CH_3$ | 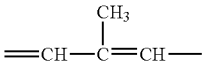 |
| IV-32 | 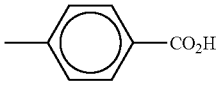 | $-CH_3$ | —CN | =CH—CH=CH— |
| IV-33 | 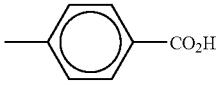 | —H | —H | =CH—CH=CH— |
| IV-34 | 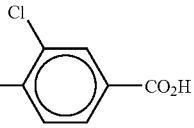 | —H | $-OC_2H_5$ | =CH—CH=CH— |
| IV-35 | 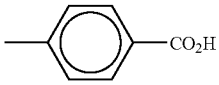 | —H | $(n)C_4H_9-$ | =CH—CH=CH— |
| IV-36 | 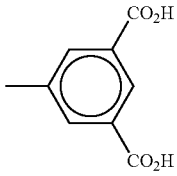 | $-CH_3$ | $-NHCH_3$ | =CH—CH=CH— |

-continued
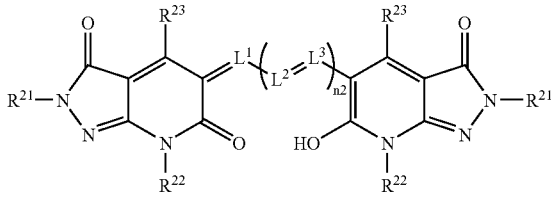
| | $R^{21}$ | $R^{22}$ | $R^{23}$ | $=L^1-(L^2=L^3)_{n2}-$ |
|---|---|---|---|---|
| IV-37 | 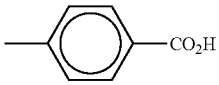 | $-COCH_3$ | $-NHCOCH_3$ | $=CH-CH=CH-$ |
| IV-38 | 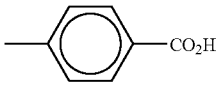 | $-CO_2CH_3$ | $-NHSO_2CH_3$ | $=CH-CH=CH-$ |
| IV-39 | 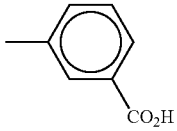 | $-CH_2CH_2OH$ | $-CH_3$ | $=CH-CH=CH-$ |
| IV-40 | $-CH_2CH_2CN$ | $-H$ | $-CH_3$ | $=CH-CH=CH-$ |
| IV-41 | 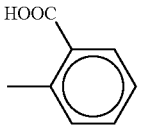 | $-H$ | $-CH_3$ | $=CH-CH=CH-$ |
| IV-42 | 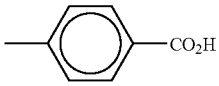 | $-H$ | $-C_2H_5$ | $=CH-CH=CH-$ |
| IV-43 | 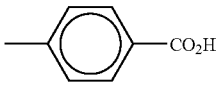 | $-CH_2CH_2OCH_3$ | $-CH_3$ | 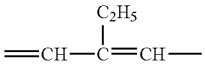 |
| IV-44 | 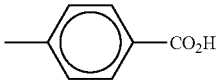 | $-H$ | $-CH_3$ | 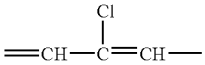 |
| IV-45 | 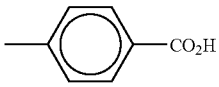 | $-H$ | $-CO_2H$ | 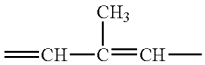 |
| IV-46 | 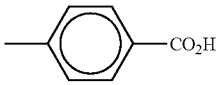 | $-H$ | $-CO_2H$ | 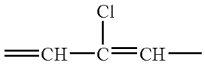 |
| IV-47 | $-CH_2CH_2CN$ | 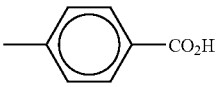 | $-CH_3$ | $=CH-CH=CH-$ |
| IV-48 | $-CH_2CH_2CN$ | 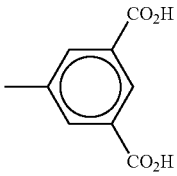 | $-CH_3$ | $=CH-CH=CH-$ |

-continued

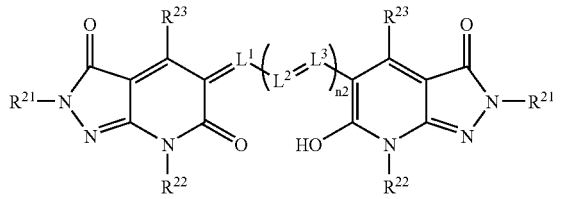

| | $R^{21}$ | $R^{22}$ | $R^{23}$ | $=L^1-(L^2=L^3)_{n2}-$ |
|---|---|---|---|---|
| IV-49 | 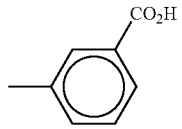 | —H | $-CH_3$ | =CH—CH=CH— |
| IV-50 | 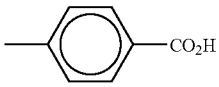 | —H | $-CH_3$ | =CH—CH=CH—CH=CH— |
| IV-51 | $-CH_3$ | 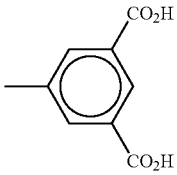 | $-CH_3$ | =CH—CH=CH—CH=CH— |

The dyes for use in the present invention may be synthesized by or according to the methods described in WO88/04794, European Patent Applications Laid-open No. 274,723A1, No. 276,566, and No. 299,435, JP-A-52-92716, JP-A-55-155350, JP-A-55-155351, JP-A-61-205934, JP-A-48-68623, U.S. Pat. No. 2,527,583, U.S. Pat. No. 3,486,897, U.S. Pat. No. 3,746,539, U.S. Pat. No. 3,933,798, U.S. Pat. No. 4,130,429 and U.S. Pat. No. 4,040,841, JP-A-3-282244, JP-A-3-7931, JP-A-3-167546, and the like.

The solid fine-particle dispersion of the dye for use in the present invention may be prepared by known methods. Details of the production methods are described in "Kinousei-Ganryo Oyogijutsu (Functional Pigment Applied Technologies)" (published by CMC, 1991) and the like.

Dispersion using media is one of general methods. In this method, a dye powder or a dye wetted by water or an organic solvent (so-called wet cake) is made into an aqueous slurry, and the resulting slurry is mechanically crushed in the presence of a dispersing medium (e.g., steel balls, ceramic balls, glass beads, alumina beads, zirconia silicate beads, zirconia beads or Ottawa sand) with an arbitrary crusher (e.g., ball mill, vibrating ball mill, planetary ball mill, vertical type sand mill, roller mill, pin mill, coball mill, caddy mill, horizontal sand mill, attritor, or the like). Among these, the average diameter of beads to be used is preferably 2 mm to 0.3 mm, more preferably I mm to 0.3 mm, and still more preferably 0.5 mm to 0.3 mm. In addition to the above methods, methods of crushing using a jet mill, roll mill, homogenizer, colloid mill or desolver, or crushing methods using a ultrasonic dispersion machine may be used.

Also, a method in which a dye is dissolved in a uniform solution and thereafter a bad solvent (poor solvent) is added to the solution to precipitate solid fine particles, as disclosed in U.S. Pat. No. 2,870,012, or a method in which a dye is dissolved in an alkaline solution and thereafter the pH of the solution is dropped to precipitate solid fine particles, as disclosed in JP-A-3-182743, may be used.

When the solid fine-particle dispersion is prepared, a dispersing aid is preferably made to be present. Details of the dispersing aid (e.g., concrete explanations, limitations of preferable ranges, and exemplified compounds), which is preferably used, are described in JP-A-2003-172984, from page 33, column 63, line 25 to page 34, column 65, line 25 (Paragraphs 0125 to 0131), and the corresponding part of the publication is incorporated by reference as a part of the present specification.

In the present invention, the amount of the above dispersing aid to be used is preferably 0.05 to 0.5, and more preferably 0.1 to 0.3, in terms of mass ratio to the dye for use in the present invention. It is preferable to have the amount of the dispersing aid to be used in the above range, in view of improving the uniformity of the applied surface:

Also, at the time of preparation of the solid fine-particle dispersion, a polyvinyl alcohol, polyvinylpyrrolidone, polyethylene glycol, polysaccharides, or hydrophilic colloid, such as a gelatin, may coexist for the purpose of stabilizing the dispersion and decreasing the viscosity of the dispersion. In the present invention, it is particularly preferable to allow the compound of the formula (VI) explained later to coexist.

The solid fine-particle dispersion of the dye, which is used in the present invention, is preferably those treated under heat before, during, or after dispersion, by such a method as described in JP-A-5-216166, in order to obtain the advantageous effects of the present invention. In the present invention, examples of the heat treatment method that is preferably applicable to the dye dispersion, include a method in which the heat treatment is performed prior to a step of micro-dispersing solid-wise, for example, by heating a dye powder in a solvent; a method in which a dye is dispersed without cooling the dye or with heating the dye, when the dye is dispersed in water or other solvents, in the presence of a dispersant; and a method in which a solution after dispersion of the dye or an coating solution is treated under heat. It is particularly preferable to carry out the heat treatment after the dye is dispersed.

When two or more kinds of the solid fine-particle dispersion containing the dye represented by the formula (I) are used in a specific layer, at least one dispersion may be heat-treated.

The pH in heat treatment during or after dispersion of the dye may be in a range required for the dispersion to exist stably, and it is preferably in a range of 2.0 to 8.0, more preferably 2.0 to 6.5, and still more preferably 2.5 or more but less than 4.5. The pH during heat treatment that is in the above range is preferable, in view of an improvement in the film strength of the coating material. For the adjustment of the pH of the dispersion, for example, sulfuric acid, hydrochloric acid, acetic acid, citric acid, phosphoric acid, oxalic acid, carbonic acid, sodium bicarbonate, sodium carbonate, sodium hydroxide, potassium hydroxide or a buffer comprising thereof may be used.

The temperature in the above heat treatment may be arbitrary selected, as far as it is in a range that is 40° C. or higher and is a temperature at which the dye is not decomposed, although it can not be determined in a wholesale manner because it differs depending upon the step at which heat treatment is conducted, the size and shape of a powder or particle, heat treating conditions, the type of solvent, and the like. In the case of heat-treating a powder, an appropriate temperature is generally 40 to 200° C., and preferably 50 to 150° C. In the case of heat-treating in a solvent, an appropriate temperature is generally 40 to 150° C., and preferably 50 to 150° C. In the case of heat-treating during dispersion, an appropriate temperature is generally 40 to 90° C., and preferably 50 to 90° C. In the case of heat-treating the dispersion solution after a dispersing step is finished, an appropriate temperature is generally 40 to 100° C., and preferably 50 to 95° C. When the temperature at heat treatment is too low, only a poor effect is obtained.

When the heat-treatment is carried out in a solvent, there is no limitation to the type of solvent as far as it does not substantially dissolve the dye. Examples of the solvent include water, alcohols (e.g., methanol, ethanol, isopropyl alcohol, butanol, isoamyl alcohol, octanol, ethylene glycol, diethylene glycol, and ethyl cellosolve), ketones (e.g., acetone, and methyl ethyl ketone), esters (e.g., ethyl acetate and butyl acetate), alkylcarboxylic acids (e.g., acetic acid and propionic acid), nitrites (e.g., acetonitrile), ethers (e.g., dimethoxyethane, dioxane and tetrahydrofuran), amides (e.g., dimethylformamide), and the like.

Even if a solvent dissolves the dye when it is used singly, such a solvent can be used if the dye is not substantially dissolved to a solution obtained by mixing the solvent with water or other solvents, or by adjusting the pH.

The time required for heat treatment also can not be determined in a wholesale manner. When the temperature is low, a long time is required, whereas when the temperature is high, only a short time is required. The heat-treating time can be determined arbitrary as far as the heat treatment is conducted within the range free from an adverse effect on the production process, and the heat-treating time is preferably one hour to 4 days in general.

The fine particles prepared in this manner are dispersed in an appropriate binder to prepare a solid dispersion of almost uniform particles, and then the dispersion is applied to a desired support, to form a layer containing the fine particles of the dye on the photographic light-sensitive material.

As the above binder, a gelatin, or a synthetic polymer, such as a polyvinyl alcohol or polyacryl amide, is usually used, although no particular limitation is imposed on the binder as far as it is a hydrophilic colloid, which can be used for light-sensitive emulsion layers or non-light-sensitive layers.

The fine particles in the solid dispersion have an average particle diameter of generally 0.005 to 10 μm, preferably 0.01 to 1 μm, and more preferably 0.01 to 0.7 μm. The particle diameter falling in this range is preferable in view of resistance to coagulation of the fine particles and of light-absorbing efficiency. The solid fine-particle dispersion of the dye represented by the above formula (I) for use in the present invention may be used singly or in combination with a plurality of solid fine-particle dispersions.

Moreover, the number of hydrophilic colloidal layers to which the solid fine particle is to be added may be either one or plural. Examples include a case where a single solid fine-particle dispersion is added to only one layer, a case where a single solid fine-particle dispersion is added to plural layers in lots, a case where plural solid fine-particle dispersions are added to only one layer simultaneously, and a case where plural solid fine-particle dispersions are respectively added to separate layers. These cases, however, are not intended to be limiting of the present invention.

Further, the solid fine-particle dispersion may be incorporated as an anti-halation layer in a necessary amount and further added to a light-sensitive silver halide emulsion layer in a necessary amount for the prevention of irradiation.

The hydrophilic colloidal layer containing the solid fine-particle dispersion of the dye represented by the formula (I), which is used in the present invention, is preferably disposed between the support and a silver halide emulsion layer closest to the support. A non-light-sensitive hydrophilic colloidal layer other than the hydrophilic colloidal layer containing the solid fine-particle dispersion may be disposed between the support and a silver halide emulsion layer closest to the support.

The solid fine-particle dispersion of the dye for use in the present invention is contained in a non-light-sensitive hydrophilic colloidal layer according to the hue of the dye, in the silver halide photographic light-sensitive material. In a light-sensitive material according to an embodiment provided with a plurality of non-light-sensitive layers, the solid fine-particle dispersion may be added to the plurality of layers.

The concentration of the dye in the above solid fine-particle dispersion for use in the present invention is generally 0.1 to 50 mass %, and preferably 2 to 30 mass %. The concentration of the dye that falls in the above range is preferable, in view of the viscosity of the dispersion. Further, the amount of the solid fine-particle dye to be applied is preferably about 0.05 to 0.5 g/m$^2$.

In the present invention, a compound represented by the following formula (VI) is preferably contained together with the above solid fine-particle dispersion, in the same photographic constitutional layer.

$$P—((S)_{m3}—R)_{n3} \qquad \text{Formula (VI)}$$

In the formula (VI), R represents a hydrogen atom, a hydrophobic group or a hydrophobic polymer, P represents a polymer containing at least one of the following units A, B and C, and having a polymerization degree of 10 or more and 3500 or less, n3 denotes 1 or 2, and m3 denotes, 1 to 0;

A:

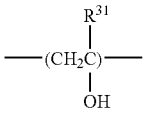

B:

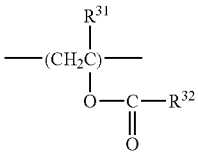

C:

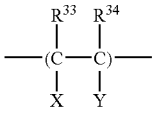

wherein $R^{31}$ represents —H or an alkyl group having 1 to 6 carbon atoms, $R^{32}$ represents —H or an alkyl group having 1 to 10 carbon atoms, $R^{33}$ represents —H or —$CH_3$, $R^{34}$ represents H, —$CH_3$, —$CH_2COOH$ (including an ammonium salt or a metal salt) or —CN, X represents —H, —COOH (including an ammonium salt or a metal salt) or —$CONH_2$, Y represents —COOH (including an ammonium salt or a metal salt), —$SO_3H$ (including an ammonium salt or a metal salt), —$OSO_3H$ (including an ammonium salt or a metal salt), —$CH_2SO_3H$ (including an ammonium salt or a metal salt), —$CONHC(CH_3)_2CH_2SO_3H$ (including an ammonium salt or a metal salt) or —$CONHCH_2CH_2CH_2N^+(CH_3)_3Cl^-$.

Details of the compound represented by the above formula (VI) that can be preferably used in the present invention (e.g., concrete explanations, limitations of preferable ranges, exemplified compounds, amount to be used, and synthetic methods) are described in JP-A-11-95371, from page 24, column 46, line 27 to page 33, column 63, line 2 (Paragraphs 0090 to 0128), and the corresponding part of the publication is incorporated by reference as a part of the present specification.

The compound represented by the formula (AS) that can be used in the present invention will be hereinafter explained in detail.

Formula (AS)

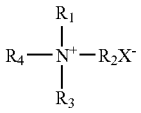

wherein $R_1$ to $R_4$ each represent an alkyl group having 1 to 4 carbon atoms, and $X^-$ represents a halogen or a hydroxyl group. $R_1$ to $R_4$ may be the same or different from each other. $R_1$ to $R_4$ each are preferably an alkyl group having 1 or 2 carbon atoms, more preferably 2 carbon atoms. X is not particularly limited as long as X is a halogen or a hydroxyl group, but X is preferably a halogen, more preferably a chlorine ion.

Preferred examples of the compound represented by the formula (AS) that can be used in the present invention will be specifically described hereinafter. However, the compound is not limited thereto in the present invention.

$(CH_3)_4N^+\cdot Cl^-$ (AS-1)

$(CH_3)_4N^+\cdot Br^-$ (AS-2)

$(CH_3)_4N^+\cdot OH^-$ (AS-3)

$(C_2H_5)_4N^+\cdot Cl^-$ (AS-4)

$(C_2H_5)_4N^+\cdot Br^-$ (AS-5)

$(C_2H_5)_4N^+\cdot OH^-$ (AS-6)

$(C_3H_7)_4N^+\cdot Cl^-$ (AS-7)

$(C_3H_7)_4N^+\cdot Br^-$ (AS-8)

$(C_3H_7)_4N^+\cdot OH^-$ (AS-9)

$(C_4H_9)_4N^+\cdot Cl^-$ (AS-10)

$(C_4H_9)_4N^+\cdot Br^-$ (AS-11)

$(C_4H_9)_4N^+\cdot OH^-$ (AS-12)

In the silver halide color photographic light-sensitive material of the present invention, the amount of the compound represented by formula (AS) to be coated is preferably 1 to 50 mg, more preferably 3 to 30 mg, and further preferably 5 to 10 mg, per 1 $m^2$ of the light-sensitive material. The method of applying the compound is not particularly limited. The compound may be applied before or after the emulsion layers are applied. When the support is formed by drawing and then the antistatic layer is formed by applying onto the side of the support opposite to the emulsion layers formed on the support, the layer may be mono-layered or multi-layered. In the case of the multi-layered layer, the compound represented by the formula (AS) may be added to any one of the layers.

In the present invention, the addition of the compound represented by formula (AS) means that the compound is added in the form of the salt represented by formula (AS). Thus, the addition does not mean that salts of the cation and the anion for forming the compound represented by formula (AS) are separately prepared and added, so that the compound represented by formula (AS) is finally present in the material as a final applied material.

If the surface electric resistance value of the antistatic layer side surface of the light-sensitive material of the present invention is too high or low, an inconvenience is caused. Before the light-sensitive material is developed, the resistance value is preferably in the range of $5\times10^9$ to $5\times10^{12}$ Ω/□ in an atmosphere having a temperature of 23° C. and a relative humidity (RH) of 65%, in order to prevent the generation of static marks. After the development, the resistance value is preferably in the range of $6.3\times10^9$ to $5\times10^{15}$ Ψ/□ in the atmosphere having a temperature of 23° C. and a relative humidity (RH) of 65%, in order to prevent the generation of a transportation trouble in a film projector or the like.

For the measurement of the surface electric resistance value, a direct current constant-voltage power source and an ammeter can be used. In the principle of the measurement, Ohm's law: E=RI, wherein E represents voltage, I represents current, and R represents resistance, is used. A constant voltage E is applied to a portion having a predetermined area in the surface of the antistatic layer of the light-sensitive material. The current I flowing at this time is measured with the ammeter in the circuit used, thereby calculating the electric resistance R per normalized area (unit: Ω/□). Furthermore, the logarithm of the resistance R is taken, and SR values are defined as follow:

$SR1$ (before color developing treatment)=Log $R1$ (before color developing treatment), and $SR2$ (after color developing treatment)=Log $R2$ (after color developing treatment).

Herein, the logarithm of the surface resistance value R1 of the surface of the light-sensitive material opposite to the emulsion-applied surface before the color developing treatment is defined as SR1, and the logarithm of surface resistance value R2 of the surface of the light-sensitive material opposite to the emulsion-applied surface after the color developing treatment is defined as SR2.

In the light-sensitive material of the present invention, the surface electric resistance value of the surface opposite to the emulsion-applied surface satisfies the following expressions:

$$0.3 \leqq (SR2-SR1) \leqq 3.0, \text{ and} \qquad \text{Expression (S)}$$

$$9.0 \leqq SR1 < 12.7. \qquad \text{Expression (T)}$$

The range of SR1 is from 9.0 to 12.7, preferably from 9.0 to 12.0, and more preferably from 9.5 to 11.0. The range of SR2 is preferably from 9.3 to 15.7, more preferably from 9.3 to 15.0, and further preferably from 9.3 to 14.5.

A specific example of the surface resistance measuring device is a combination of a constant voltage power source (trade name: TR-300C) and an ammeter (trade name: TR-8651) manufactured by Takeda Riken Kogyo with a sample chamber manufactured thereby (trade name: TR-42). In this case, as a resistance reference, a product of the trade name "STANDARD RESISTOR TR-45" is used.

Next, an approach of an idea for preventing an electrostatic trouble is described herein. When a light-sensitive material is transported with a film projector or the like, static electricity is generated as described above so that the light-sensitive material may be electrified. It is known that the attenuation of the electrification voltage is represented by the following expression:

$$Vt = Vo \cdot \exp(-t/\tau)$$

wherein Vo represents the initial electrification voltage, Vt represents the voltage at the time t, and $\tau$ represents a time constant.

In the expression, $\tau$ can be represented by CR wherein C represents the electrostatic capacity, and R represents the leakage current (=the electric resistance).

The matter that the time constant X is small means that even if a large amount of electric charges is generated, the charges leak instantaneously so that the electrification quantity does not become large. It is therefore preferred that the electric resistance R is small in order to prevent the generation of a static mark in a light-sensitive material before the material is developed. In many of places where light-sensitive materials are handled before they are developed, temperature and humidity are controlled; thus, the property of the materials can be represented by the electric resistance thereof at a temperature of 23° C. and a relative humidity of 65%, which correspond to a typical condition.

However, it cannot be said that as the electric resistance is smaller, the resistance is more preferred. In the case that a light-sensitive material is in the state that the material is not electrostatically earthed, an electrostatic trouble is more easily caused as the resistance is smaller. For example, when a developed light-sensitive material is transported with a horizontal platter type film projector or the like, static electrification is generated by friction between the material and a roller at the center of the horizontal platter. In order to cancel electric charges based on the static electrification, electric charges having a reverse symbol are supplied to the charged portion from portions other than the charged portion. When the time constant of the material is small, this supply is instantaneously attained and the charge-supplying source turns temporarily into an electrically biased state since the source has supplied the charges having one of positive electricity and negative electricity. In the case that the light-sensitive material is not earthed, the electrically biased state is not cancelled and further the light-sensitive material is successively transported so that static electrification is continuously generated by friction between the material and the roller. In such a way, an electrostatic trouble is caused in the developed light-sensitive material.

In order to prevent this problem, it is preferred to make the electric resistance of a light-sensitive material somewhat large to make the time constant large, thereby making large the time necessary for canceling the static electricity generated by the friction between the material and the roller so as to decrease the degree that the material is electrically biased.

Thus, SR2 is preferably larger than SR1. The value of(SR2−SR1) ranges preferably from 0.3 to 3.0, more preferably from 0.5 to 1.5.

The support will be hereinafter explained.

In the present invention, as the support, a transmission-type support is used, and a plastic film support is preferable. Examples of the plastic film support include films, for example, of a polyethylene terephthalate, a polyethylene-2, 6-dinaphthalate, a polypropylene terephthalate, a polybutylene terephthalate, a cellulose triacetate, a cellulose acetate butylate, a cellulose acetate propionate, a polycarbonate, a polystyrene, and a polyethylene. Among these plastic film supports, a polyester support is preferred. Specifically, polyethylene terephthalate films are preferable and biaxially oriented (stretched) and thermally fixed polyethylene terephthalate films are particularly preferable in view of stability, toughness and the like.

The thickness of the support is generally 15 to 500 μm, preferably 40 to 200 μm in view of ease of handling and usability for general purposes, though no particular limitation is imposed on the thickness of the above support.

The support may be transparent, or may contain an anthraquinone dye, dyed silicon, silicon dioxide, alumina sol, a chrome salt, a zirconium salt, titanium oxide, or the like.

The following surface treatment is generally carried out on the surface of the plastic film support, to bond light-sensitive layers firmly with the surface. The surface on the side where an antistatic layer (a backing layer) is formed is generally subjected to a surface treatment in the similar manner. Specifically, there are the following two methods:

(1) A method, in which a surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment, or ozone oxygen treatment, is carried out, and then a photographic emulsion (a coating solution for formation of a light-sensitive layer) is directly applied, to obtain adhesive force; and (2) A method, in which after the above surface treatment is once carried out, an undercoating layer is formed, and a photographic emulsion layer is applied onto the undercoating layer.

Among these methods, the method (2) is more effective and hence widely used. These surface treatments each are assumed to have the effects of: forming a polar group in some degree on the surface of the support, which is originally hydrophobic, removing a thin layer that gives an adverse effect on the adhesion of the surface, and increasing the crosslinking density of the surface, thereby increasing the adhesive force. As a result, it is assumed that, for example, the affinity of components contained in a solution of the undercoating layer to the polar group is increased and the fastness of the bonded surface is increased, thereby improving adhesion between the undercoating layer and the surface of the support.

The method of applying the undercoating layer is classified into the so-called multilayer method, wherein a layer sufficiently adhesive to the support is formed as a first layer and then a gelatin layer is formed by applying on the first layer; and the so-called monolayer method, wherein only one resin layer containing both of a hydrophobic group and a hydrophilic group is applied. An example of the method of forming the undercoating layer includes a method of forming, in an aqueous system, a bi-layered undercoating layer made of a first undercoating layer made of a polymeric material and a second undercoating layer made of gelatin. Examples of the polymeric material for the first undercoating layer include any copolymer made of one starting material of which is selected from vinyl chloride, vinylidene chloride, butadiene, methacrylic acid, acrylic acid, itaconic acid, maleic anhydride and others; polyethyleneimine, epoxy resin grafted gelatin, and nitrocellulose. In the formation of the first undercoating layer and the second undercoating layer of gelatin, a curing agent is generally used together, examples of which include dichlorotriazine derivatives, epoxy compounds, and vinylsulfone compounds.

If desired, a swelling agent may be added to the first undercoating layer. Examples thereof include phenol and resorcin. The addition amount thereof is from 1 to 10 g per liter of the coating solution for the first undercoating layer. In the first undercoating layer, a hydrophilic polymer may be used. Examples thereof include natural polymers such as gelatin; and synthetic polymers such as polyvinyl alcohol, vinyl acetate/maleic anhydride copolymer, acrylic acid/acrylamide copolymer, and styrene/maleic anhydride copolymer. Furthermore, a blocking inhibitor may be used. Examples thereof include a mat agent (for example, silicon dioxide, aluminum oxide, barium sulfate, polymethyl acrylate, or polystyrene), methylcellulose, and polyvinyl alcohol.

The undercoating solution for the first undercoating layer can be coated by any one of generally well-known methods, such as a dip coating, an air-knife coating, a curtain coating, a roller coating, a wirebar coating, a gravure coating, and an extrusion coating using a hopper, as described in the specification of U.S. Pat. No. 2,681,294. Furthermore, in the case of applying the second undercoating layer onto the above-undercoating layer, two layers or higher multilayers can be simultaneously coated by a method as described, for example, in the specifications of U.S. Pat. Nos. 2,761,791, 3,508,947, 2,941,898, and 3,526,528, and by Ozaki et al., in "Coating Technology (Coating Kogaku)" p. 253 (published by Asakura Shoten, 1973).

The coating amounts of the first undercoating layer and the second undercoating layer on the first understand layer, as solid components, are preferably from 0.01 to 10 g, more preferably from 0.2 to 3 g, per square meter of the polyester-film support. In the present invention, a hydrophilic colloidal layer made mainly of gelatin is generally formed as the second undercoating layer on the first undercoating layer.

Examples of the hydrophilic polymer which is used in the second undercoating layer other than gelatin include acylated gelatin (such as phthalic acid modified gelatin, and maleic acid modified gelatin), cellulose derivatives (such as carboxymethylcellulose, and hydroxyethyl cellulose), a grafted gelatin wherein acrylic acid, methacrylic acid or amide is grafted to gelatin, polyvinyl alcohol, polyhydroxyalkyl acrylate, polyvinyl pyrrolidone, vinyl pyrrolidone/vinyl acetate copolymer, casein, agarose, albumin, sodium alginate, polysaccharide, agar, starch, grafted starch, polyacrylamide, polyethyleneimine acyl compound; a homopolymer or a copolymer made from acrylic acid, methacrylic acid, acrylamide, N-substituted acrylamide or N-substituted methacrylamide, and a partially hydrolyzed product thereof; and other synthetic or natural hydrophilic polymeric compounds. These may be used alone or in a mixture form. If necessary, an antistatic agent, a crosslinking agent, a mat agent, a blocking inhibitor, or the like can be added to the hydrophilic polymer as described above.

The antistatic agent is preferably electroconductive metal oxide particles. It is more preferred that the agent contains fine particles in order to decrease printing dust at the time of using the light-sensitive material, improve the transportability and prevent the particles from falling off. The agent generally contains a binder, and may optionally contain a surfactant, a lubricant or other components.

From the viewpoint of the transparency, strength, and antistatic property of the film, the electroconductive metal oxide particles are preferably needle-form metal oxide particles, and the metal oxide is a metal oxide selected from the group consisting of ZnO, $TiO_2$, $SnO_2$, $Al_2O_3$, $In_2O_3$, MgO, complex metal oxides of these metal oxides, and metal oxides containing at least one of these metal oxides and a different atom. Of these, $SnO_2$, ZnO, $In_2O_3$ and $TiO_2$ are preferable, and $SnO_2$ is more preferable.

Example of the metal oxide containing a small amount of a different atom may include those obtained by doping ZnO with a small amount of Al or In, $TiO_2$ with a small amount of Nb or Ta, $In_2O_3$ with a small amount of Sn, and $SnO_2$ with a small amount of Sb, Nb, or a halogen atom.

The dope amount of the different atom with which the metal oxide is doped is preferably from 0.01 to 30 mol %, more preferably from 0.1 to 10 mol %. If the dope amount of the different atom is too small, sufficient electroconductivity may not be given to the oxide or complex oxide. If the dope amount is too large, the blackening of the metal oxide particles theirselves is increased, leading to the formation of a blackish antistatic layer. As a result, there particles in an amount out of the above ranges are unsuitable for the silver halide photographic light-sensitive material in some cases.

Those having an oxygen defect in their respective crystal structure are also preferable. Among the above-mentioned metal oxide particles containing a small amount of a different atom, $SnO_2$ particles doped with antimony is preferred, and $SnO_2$ particles doped with 0.2 to 2.0 mol % of antimony is more preferred.

As the size of the electroconductive metal oxide particles, the ratio of the long axis length to the short axis length (the long-axis/short-axis ratio) is preferably from 3 to 50, more preferably from 10 to 50.

The short axis length of the electroconductive metal oxide particles is preferably from 0.001 to 0.1 μm, and more preferably from 0.01 to 0.02 μm; and the long axis length of the electroconductive metal oxide particles is preferably from 0.1 to 5.0 μm, and more preferably from 0.1 to 2.0 μm.

In the present invention, in particular, by using metal oxide particles, such as $SnO_2$ doped with antimony, having the above-mentioned preferable long-axis/short-axis ratio, short axis length and long axis length, an antistatic layer which exhibits good electroconductivity, has excellent antistatic performance, and has a small haze ratio to exhibit excellent transparency, can be formed.

In the present invention, by using the needle-form metal oxide particles having the above-mentioned preferable short and long axis lengths, an antistatic layer which exhibits good electroconductivity, has excellent antistatic performance, and has a small haze ratio to exhibit excellent transparency, can be formed. The reason therefor would be as follows.

About each of the above-mentioned needle-form metal oxide particles, inside the antistatic layer, the long axis extends long in parallel to the surface of the antistatic layer; however, in the thickness direction of the layer, the particles occupy the layer only by the length of the short axis. Such needle-form metal oxide particles contact each other more easily than ordinary spherical particles since the needle particles are longer in the long axis direction thereof. Thus, high electroconductivity can be obtained even if the amount of the needle particles is small. Accordingly, the needle particles would exhibit a decrease in the surface electric resistance without damaging the transparency.

In addition, in the needle-form metal oxide particles, the short axis length is usually smaller than or substantially equal to the thickness of the antistatic layer. Thus, the surface hardly projects. Even if the surface projects, the quantity of the projecting portions is slight. Thus, the projecting portions are substantially completely covered with the protective layer formed on the antistatic layer. It is, therefore, possible to prevent white powder stain generated by the elimination of the metal oxide particles projecting from the layer when the support is transported in the production process, or the silver halide color photographic light-sensitive material is handled or transported in photographing or developing. Further, in the case that spherical particles are used to make a silver halide color photographic light-sensitive material, a fluctuation in the surface electric resistance values before and after this material is developed is relatively large; on the other hand, in the case of using the needle metal oxide particles, such a fluctuation is very small. Thus, in particular, the transportability after the development can be remarkably improved. This would be because in the case of the spherical particles, the arrangement state of the particles is easily changed by swelling or contraction (shrinkage) of the film based on the development, and thus the quantity of contacting portions among the particles becomes smaller than that of contacting portions of the needle particles.

When the needle-form metal oxide particles are used, the film strength of the antistatic layer can be made high. Thus, it is also possible to prevent the elimination of the antistatic agent, that is, white stain of the applied materials when the light-sensitive material is transported, developed, or discharged from a camera or the like in the producing- or handling-process of the light-sensitive material.

The content of the metal oxide particles in the antistatic layer is preferably from 2 to 2000 mg/m$^2$, more preferably from 50 to 1000 mg/m$^2$, and particularly preferably from 50 to 500 mg/m$^2$ from the viewpoint of antistatic property and transparency. If the content is too little, sufficient antistatic performance may not be obtained. If the content is too large, the haze value may become high so that the transparency may remarkably deteriorate. It is allowable to use, as an antistatic agent, a known antistatic agent which can be used in a silver halide photographic light-sensitive layer described below together with the about-described needle metal oxide particles.

Other useful examples of the electroconductive material used in the antistatic layer for use in the light-sensitive material of the present invention include semiconductor metal salts, such as cuprous iodide, described in U.S. Pat. Nos. 3,245,833, 3,428,451, and 5,075,171; fibrous electroconductive powder containing tin oxide doped with antimony applied onto non-electroconductive potassium titanate whisker, described in U.S. Pat. Nos. 4,845,369 and 5,116,666; electroconductive polymers, such as crosslinked vinylbenzene quaternary ammonium polymer, described in U.S. Pat. No. 4,070,189; electroconductive polyanilines described in U.S. Pat. No. 4,237,194; electroconductive polythiophenes described in U.S. Pat. Nos. 4,987,042, 5,035,926, 5,354,613, 5,370,981, 5,372,924, 5,543,944, and 5,766,515; and colloid gel made of vanadium pentoxide or vanadium pentoxide doped with silver, described in U.S. Pat. Nos. 4,203,769, 5,006,451, 5,221,598 and 5,284,714.

Next, the photographic layers of the silver halide color light-sensitive material for use in motion-picture projection of the present invention, and other constituents of the material are described below.

The silver halide color photographic light-sensitive material of the present invention is a silver halide color photographic light-sensitive material comprising a transmission-type support and on the support, at least one light-sensitive layer, on the support, composed of plural silver halide emulsion layers substantially different from each other in color sensitivity. The present invention can be preferably applied to color photographic light-sensitive materials for ordinary use or movies, such as color positive films and positive films for movie. Of these applications, the present invention is particularly preferably applied to the color positive light-sensitive materials for movie.

The present invention has no particular restrictions as to the number of light-sensitive silver halide emulsion layers, the number of non-light-sensitive hydrophilic colloidal layers, and the arranging order of these layers. Each of the yellow-, cyan- and magenta-color-forming light-sensitive silver halide emulsion layers may be made of one light-sensitive silver halide emulsion layer, or plural silver halide emulsion layers which have the same color sensitivity but have different sensitivities.

Each of the color-forming light-sensitive silver halide emulsion layers has no particular restrictions as to the relationship between the color formation and the color sensitivity. For instance, a color-forming light-sensitive silver halide emulsion layer may have color sensitivity in the infrared region.

A typical example of the arranging order of the constituent layers is, in increasing order of distance from the support, a non-light-sensitive hydrophilic colloid layer containing a dispersion of solid fine particles of dye and/or black colloidal silver, a yellow-color-forming light-sensitive silver halide emulsion layer, a non-light-sensitive hydrophilic colloidal layer (color-mixing-preventing layer), a cyan-color-forming light-sensitive silver halide emulsion layer, a non-light-sensitive hydrophilic colloidal layer (color-mixing-preventing layer), a magenta-color-forming light-sensitive silver halide emulsion layer, and a non-light-sensitive hydrophilic colloidal layer (protective layer). Depending on the intended purposes, however, changes may be made in the above-mentioned arranging orders, or in the number of light-sensitive silver halide emulsion layers or non-light-sensitive hydrophilic colloidal layers.

In the silver halide color light-sensitive material of the present invention, Fe is brought mainly from gelatin, dyes, and emulsion grains intentionally doped with Fe. The Fe content in the present invention is preferably $2\times10^{-5}$ mol/m$^2$ or less (preferably from $1\times10^{-8}$ to $2\times10^{-5}$ mol/m$^2$), more preferably $8\times10^{-6}$ mol/m$^2$ or less (preferably from $1\times10^{-8}$ to $8\times10^{-6}$ mol/m$^2$), and most preferably $3\times10^{-6}$ mol/m$^2$ or less (preferably from $1\times10^{-8}$ to $3\times10^{-6}$ mol/m$^2$).

In the present invention, gelatin is preferably used as hydrophilic colloid. Further, other hydrophilic colloid besides gelatin can also be used with replacing gelatin in an arbitrary ratio. Examples include gelatin derivatives, graft polymers of gelatin with another polymer, proteins such as albumin and casein; cellulose derivatives, such as hydroxyethyl celluloses, carboxymethyl celluloses, and cellulose sulfates; sodium alginates, saccharides, such as starch derivatives; and various synthetic polymers, including polyvinyl alcohols, polyvinyl alcohol partial acetals, poly-N-vinylpyrrolidones, polyacrylic acids, polymethacrylic acids, polyacrylamides, polyvinylimidazoles, and polyvinylpyrazoles.

The silver halide grains for use in the present invention includes silver chloride, silver bromide, silver (iodo)chlorobromide, silver iodobromide, and the like. Particularly, in the present invention, in view of reducing development processing time, it is preferable to use silver chloride, silver chlorobromide, silver chloroiodide, silver chloroiodobromide, each having silver chloride content of 95 mol % or more. The silver halide grains in the emulsion may be those comprising regular crystals having, for example, a cubic, octahedron, or tetradecahedron form, those comprising irregular crystals having, for example, a spherical or plate form, those having crystal defects such as a twin plane, or complex systems of these crystals. Also, use of a tabular grain having a (111) plane or a (100) plane as its principal plane, is preferable in view of achieving rapid color development processing and decreasing color contamination in the processing. The tabular high-silver-chloride emulsion grains having a (111) plane or a (100) plane as its principal plane may be prepared by the methods disclosed in JP-A-6-138619, U.S. Pat. No. 4,399,215, U.S. Pat. No. 5,061,617, U.S. Pat. No. 5,320,938, U.S. Pat. No. 5,264,337, U.S. Pat. No. 5,292,632, U.S. Pat. No. 5,314,798, and U.S. Pat. No. 5,413,904, WO94/22051, and the like.

As a silver halide emulsion which can be used in combination with the above emulsions, in the present invention, any silver halide emulsion having an arbitrary halogen composition may be used. However, in view of rapid processability, silver (iodo)chloride and silver chloro(iodo)bromide, each having 95 mol % or more of silver chloride are preferable, and further, a silver halide emulsion having 98 mol % or more of silver chloride is preferable.

In the present invention, silver halide grain in the photographic emulsion may be one having a regular crystal form such as a cubic, octahedron or tetradecahedron form; one having crystal defects such as a twin plane, or complex system thereof. As to the grain diameter of the silver halide, either fine grains having a grain diameter of about 0.2 μm or less, or large-size grains whose projected-area-equivalent diameter is up to about 10 μm, may be adopted, and further it may be a polydisperse emulsion or monodisperse emulsion. The silver halide grains for use in the present invention are preferably monodispersion for the purpose of accelerating the development progress. A coefficient of variation in the grain size of each silver halide grain is preferably 0.3 or less (more preferably 0.3 to 0.05) and more preferably 0.25 or less (more preferably 0.25 to 0.05). The coefficient of variation so-called here is expressed by the ratio (s/d) of the statistical standard deviation (s) to the average grain size (d).

The silver halide photographic emulsions that can be used in the present invention may be prepared, for example, by the methods described in Research Disclosure (hereinafter abbreviated to as RD) No. 17643 (December 1978), pp. 22-23, "I. Emulsion preparation and types", and ibid. No. 18716 (November 1979), p. 648, and ibid. No. 307105 (November, 1989), pp. 863-865; the methods described by P. Glafkides, in Chemie et Phisique Photographique, Paul Montel (1967); the method described by G. F. Duffin, in Photographic Emulsion Chemistry, Focal Press (1966); and the method described by V. L. Zelikman et al., in Making and Coating of Photographic Emulsion, Focal Press (1964).

Monodispersed emulsions described in U.S. Pat. No. 3,574,628, and U.S. Pat. No. 3,655,394, and U.K. Patent No. 1,413,748 are also preferable. Tabular grains having an aspect ratio of about 3 or more can also be used in the present invention. Such tabular grains may be prepared easily, according to the methods described by Gutoff, in Photographic Science and Engineering, Vol. 14, pp. 248-257 (1970); U.S. Pat. No. 4,434,226, U.S. Pat. No. 4,414,310, U.S. Pat. No. 4,433,048, and U.S. Pat. No. 4,439,520, and U.K. Patent No. 2,112,157.

As to the crystal structure in the present invention, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion for use in the present invention, can be any one of a surface latent image-type that forms a latent image primarily on the grain surface, an internal latent image-type that forms a latent image inside the grain, and another type of emulsion that forms a latent image both on the surface and inside the grain; but it must be a negative type emulsion in any case. Among the internal latent image type emulsions, an emulsion of a core/shell type internal latent image type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development process or the like.

As the silver halide emulsion, generally, those subjected to physical ripening, chemical ripening, and spectral sensitization are used. Additives to be used in these steps are described in RD Nos. 17643, 18716, and 307105. Their relevant parts are listed in a table described later.

In the light-sensitive material of the present invention, two or more types of emulsions differing in at least one feature among the grain size, the distribution of grain size, the halogen composition, the shape of grain, and the sensitivity of light-sensitive silver halide emulsion, may be mixed and used in one layer.

The amount of silver to be applied in the silver halide color photographic light-sensitive material of the present invention, is preferably 6.0 g/m$^2$ or less, more preferably 4.5 g/m$^2$ or less, and particularly preferably 2.0 g/m$^2$ or less. Further, the amount of silver to be applied is generally 0.01 g/m$^2$ or more, preferably 0.02 g/m$^2$ or more, and more preferably 0.5 g/m$^2$ or more.

In the present invention, a 1-aryl-5-mercaptotetrazole compound, in an amount of preferably $1.0\times10^{-5}$ to $5.0\times10^{-2}$ mol, and more preferably $1.0\times10^{-4}$ to $1.0\times10^{-2}$ mol, per mol of silver halide, is preferably added to any one layer of the photographic structural layers: the light-sensitive silver halide emulsion layers and non-light-sensitive hydrophilic colloidal layers (intermediate layers and protective layers) disposed on the support; and the compound is preferably added to a silver halide emulsion layer. The addition of this compound in an amount falling in the above range further reduces stains to the surface of a processed color photograph after continuous processing.

As the I-aryl-5-mercaptotetrazole compound, preferred is one in which the aryl group at the 1-position is an unsubstituted or substituted phenyl group. Preferable specific examples of the substituent include an acylamino group (e.g., an acetylamino group and —$NHCOC_5H_{11}$(n)), a ureido group (e.g., a methylureido group), an alkoxy group (e.g., a methoxy group), a carboxylic acid group, an amino group, and a sulfamoyl group. A plurality of groups (e.g. two to three groups) selected from these groups may be bonded with the phenyl group. Also, the position of the substituent is preferably the meta or para position. Specific examples of the compound include 1-(m-methylureidophenyl)-5-mercaptotetrazole and 1-(m-acetylaminophenyl)-5-mercaptotetrazole.

The photographic additives that can be used or can be used in combination in the present invention are described in the following Research Disclosures (RD), whose particular parts are given below in a table.

| Kind of Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | | p. 648 (right column) | |
| 3 Spectral sensitizers and Supersensitizers | pp. 23-24 | pp. 648 (right column)-649 (right column) | pp. 866-868 |
| 4 Brightening agents | p. 24 | pp. 647 (right column) | p. 868 |
| 5 Light absorbers, Filter dyes, and UV Absorbers | pp. 25-26 | pp. 649 (right column)-650 (left column) | p. 873 |
| 6 Binders | p. 26 | p. 651 (left column) | pp. 873-874 |
| 7 Plasticizers and Lubricants | p. 27 | p. 650 (right column) | p. 876 |
| 8 Coating aids and Surfactants | pp. 26-27 | p. 650 (right column) | pp. 875-876 |
| 9 Antistatic agents | p. 27 | p. 650 (right column) | pp. 876-877 |
| 10 Matting agents | | | pp. 878-879 |

In the silver halide color photographic light-sensitive material of the present invention, the following dye-forming couplers are particularly preferably used, though various dye-forming couplers can be used:

Yellow couplers: couplers represented by the formula (I) or (II) in EP502,424A; couplers represented by the formula (1) or (2) in EP513,496A (particularly, Y-28 on page 18); couplers represented by the formula (I) in claim 1 in JP-A-5-307248; couplers represented by the formula (I) in U.S. Pat. No. 5,066,576, column 1, line 45 to line 55; couplers represented by the formula (I) in JP-A-4-274425, Paragraph 0008; couplers described in claim 1 in EP498,381A1, page 40 (particularly, D-35 on page 18); couplers represented by the formula (Y) in EP447,969A1, page 4 (particularly Y-1 (page 17) and Y-54 (page 41)); and couplers represented by one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A-4-73 and -75 (page 139) in EP456,257; M-4, -6 (page 26) and M-7 (page 27) in EP486,965; M-45 in JP-A-6-4361 1, Paragraph 0024; M-1 in JP-A-5-204106, Paragraph 0036; M-22 in JP-A-4-362631, Paragraph 0237.

Cyan couplers: CX-1, 3, 4, 5, 11, 12, 14 and 15 (page 14 to page 16) in JP-A-4-204843; C-7, 10 (page 35), 34, 35 (page 37), (I-1), (I-17) (page 42 to page 43) in JP-A-4-43345; and couplers represented by the formula (Ia) or (Ib) in claim 1 in JP-A-6-67385.

Polymer couplers: P-1 and P-5 (page 11) in JP-A-2-44345.

As couplers that form a color dye having a suitable diffusive property, those described in U.S. Pat. No. 4,366,237, GB 2,125,570, EP 96,873B, and DE 3,234,533 are preferable.

As couplers for compensating unnecessary absorption of color dye, yellow-colored cyan couplers represented by the formula (CI), (CII), (CIII) or (CIV) described on page 5 in EP456,257A1 (particularly YC-86, on page 84), yellow-colored magenta couplers ExM-7 (page 202), EX-1 (page 249) and Ex-7 (page 251) described in the same EP publication, magenta-colored cyan couplers CC-9 (column 8) and CC-13 (column 10) described in U.S. Pat. No. 4,833,069, and colorless masking couplers represented by the formula [C-1] described in claim 1 in WO92/11575 (particularly, the exemplified compounds on page 36 to page 45) and (2) (on column 8) of U.S. Pat. No. 4,837,136, are preferable.

Examples of the compound (including a dye-forming coupler) which reacts with an oxidized product of a developing agent to release a photographically useful compound residue, includes the followings:

Development inhibitor releasing compounds: compounds represented by the formula (I), (II), (III) or (IV) described in EP 378,236A1, page 11 (particularly T-101 (page 30), T-104 (page 31), T-113 (page 36), T-131 (page 45), T-144 (page 51) and T-158 (page 58)), compounds represented by the formula (I) in EP 436,938A2, page 7 (particularly, D-49 (page 51)), compounds represented by the formula (I) in JP-A-5-307248 (particularly, (23) in Paragraph 0027)) and compounds represented by the formula (I), (II) or (III) in EP 440,195A2, page 5 to page 6 (particularly, I-(1) on page 29)).

Bleaching-accelerator-releasing compounds: compounds represented by the formula (I) or (I') described in EP 310,125A2, page 5 (particularly (60) and (61) on page 61) and compounds represented by the formula (I) in claim 1 in JP-A-6-5941 1 (particularly, (7) in Paragraph 0022).

Ligand-releasing compounds: compounds represented by LIG-X described in claim 1 in U.S. Pat. No. 4,555,478 (particularly, compounds described in column 12, lines 21 to 41).

Leuco dye-releasing compounds: compounds 1 to 6 in U.S. Pat. No. 4,749,641, columns 3 to 8.

Fluorescent dye-releasing compounds: compounds represented by COUP-DYE in claim 1 in U.S. Pat. No. 4,774,181 (particularly compounds 1 to 11 in columns 7 to 10).

Compounds, which release a development accelerator or fogging agent: compounds represented by the formula (1), (2) or (3) in U.S. Pat. No. 4,656,123, column 3 (particularly, (I-22) in column 25) and ExZK-2 in EP 450,637A2, page 75, line 36 to line 38.

Compounds which release a group that becomes a dye only after being spilt-off: compounds represented by the formula (I) in claim 1 in U.S. Pat. No. 4,857,447 (particularly, Y-1 to Y-19 in columns 25 to 36).

As additives other than the dye-forming coupler, the following ones are preferable. ps Dispersion media for an oil-soluble organic compound: P-3, 5, 16, 19, 25, 30, 42, 49, 54, 55, 66, 81, 85, 86 and 93 (page 140 to page 144) in JP-A-62-215272;

Latex for impregnation of oil-soluble organic compound: latex described in U.S. Pat. No. 4,199,363;

Scavengers for an oxidized product of a developing agent: compounds represented by the formula (I) in U.S. Pat. No. 4,978,606, column 2, line 54 to line 62 (particularly I-(1), (2), (6), (12) (columns 4 to 5)) and compounds represented by the formula in U.S. Pat. No. 4,923,787, column 2, line 5 to line 10 (particularly Compound 1 (column 3);

Stain preventive agents: compounds represented by one of the formulae (I) to (III) in EP 298321A, page 4, line 30 to line 33 (particularly, I-47, 72, III-1, 27 (page 24 to page 48));

Anti-fading agents: A-6, 7, 20, 21, 23, 24, 25, 26, 30, 37, 40, 42, 48, 63, 90, 92, 94 and 164 (page 69 to page 118) in EP 298321A, and II-1 to III-23 in U.S. Pat. No. 5,122,444, columns 25 to 38 (particularly, III-10), I-1 to III-4 in EP 471347A, page 8 to page 12 (particularly, II-2), and A-1 to 48 in U.S. Pat. No. 5,139,931, columns 32 to 40 (particularly A-39 and 42);

Materials for reducing the amount to be used of a color development-enhancing agent or color contamination preventive agent: I-1 to II-15 in EP 411324A, page 5 to page 24 (particularly, I-46);

Formalin scavengers: SCV-1 to 28 in EP 477932A, page 24 to page 29 (particularly SCV-8);

Hardener: H-1, 4, 6, 8 and 14 in JP-A-1-214845 in page 17, compounds (H-1 to H-54) represented by one of the formulae (VII) to (XII) in U.S. Pat. No. 4,618,573, columns 13 to 23, compounds (H-1 to 76) represented by the formula (6) in JP-A-2-214852, page 8, lower right (particularly, H-14), and compounds described in claim 1 in U.S. Pat. No. 3,325,287;

Development-inhibitor precursors: P-24, 37, 39 (page 6 to page 7) in JP-A-62-168139 and compounds described in claim 1 of U.S. Pat. No. 5,019,492 (particularly 28 to 29 in column 7);

Antiseptics and mildew-proofing agents: I-1 to III-43 in U.S. Pat. No. 4,923,790, columns 3 to 15 (particularly I-1, 9, 10 and 18 and III-25), Stabilizers and antifoggants: I-1 to (14) in U.S. Pat. No. 4,923,793, columns 6 to 16 (particularly, I-1, 60, (2) and (13), and compounds 1 to 65 in U.S. Pat. No. 4,952,483, columns 25 to 32 (particularly, 36);

Chemical sensitizers: triphenylphosphine selenide and compound 50 in JP-A-5-40324;

Dyes that can be used in combination with: a-1 to b-20 on page 15 to page 18 (particularly, a-1, 12, 18, 27, 35, 36, b-5) and compounds V-1 to 23 on pages 27 to 29, (particularly, V-1) in JP-A-3-156450, F-I-1 to F-II-43 in EP 445627A, page 33 to page 55 (particularly F-I-11 and F-II-8), III-1 to 36 in EP 457153A, page 17 to page 28 (particularly III-1 and 3), compounds 1 to 22 in EP319999A, page 6 to page 11 (particularly, compound 1), compounds D-1 to 87 (page 3 to page 28) represented by one of the formulae (1) to (3) in EP 519306A, compounds 1 to 22 (columns 3 to 10) represented by the formula (I) in U.S. Pat. No. 4,268,622, compounds (1) to (31) (columns 2 to 9) represented by the formula (I) in U.S. Pat. No. 4,923,788;

UV absorbers: compounds (18b) to (18r) and 101 to 427 (page 6 to page 9) represented by the formula (1) in JP-A-46-3335, compounds (3) to (66) (page 10 to page 44) represented by the formula (I), compounds HBT-1 to HBT-10 (page 14) represented by the formula (III) in EP 520938A and compounds (1) to (31) (columns 2 to 9) represented by the formula (1) in EP 521823.

The silver halide color photographic light-sensitive material of the present invention may advantageously contain a fluorine-containing compound in a layer remotest from the support on the side having emulsion layers or a layer remotest from the support on the side having no emulsion layer, or in both the layers.

In the silver halide color photographic light-sensitive material of the present invention, the sum of the film thicknesses of all hydrophilic colloidal layers on the side provided with the emulsion layers is preferably 28 μm or less, more preferably 23 μm or less, still more preferably 18 μm or less, and particularly preferably 16 μm or less. Further, the sum of the film thicknesses is generally 0.1 μm or more, preferably 1 μm or more, and more preferably 5 μm or more.

The film swelling rate $T_{1/2}$ is preferably 60 seconds or less, and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The term "film thickness" means a film thickness measured under controlled humid conditions of 25° C. and a relative humidity of 55% (2 days). $T_{1/2}$ can be measured using a swellometer of the type described by A. Green et al. in Photogr. Sci. Eng, Vol. 19, 2, page 124 to page 129. $T_{1/2}$ can be regulated by adding a hardener to a gelatin used as a binder, or by changing aging conditions after coating.

The rate of swelling is preferably 180 to 280%, and more preferably 200 to 250%. Here, the term "rate of swelling" means a standard showing the magnitude of equilibrium swelling when the silver halide photographic light-sensitive material of the present invention is immersed in 27° C. distilled water to swell the material, and it is given by the following equation:

$$\text{Rate of swelling (unit: \%)} = (\text{Total film thickness when swelled})/(\text{Total film thickness when dried}) \times 100.$$

The above rate of swelling can be made to fall in the above range by adjusting the amount of a gelatin hardener to be added.

The silver halide color photographic light-sensitive material for movie of the present invention can be processed through standard processing steps for a positive light-sensitive material for movie. Conventional standard processing steps for a positive light-sensitive material for movie (except for a drying process)

(1) Color developing bath
(2) Stop bath
(3) Wash bath
(4) First fixing bath
(5) Wash bath
(6) Bleach-accelerating bath
(7) Bleaching bath
(8) Wash bath
(9) Sound development (coating development)
(10) Wash bath
(11) Second fixing bath
(12) Wash bath
(13) Stabilizing bath In the present invention, when, among the above process steps, color developing time (the above step (1)) is 2 minutes and 30 seconds or less (the lower limit is preferably 6 seconds or more, more preferably 10 seconds or more, further more preferably 20 seconds or more, and most preferably 30 seconds or more), and more preferably 2 minutes or less (the preferable lower limits are as same as those mentioned for the developing time of 2 minutes and 30 seconds or less), the effects of the present invention are remarkable, and therefore such a developing time is preferable.

The pH of a coating in the silver halide color photographic light-sensitive material of the present invention is preferably 4.6 to 6.4, and more preferably 5.5 to 6.5. When the pH of the coating is too high, in a sample long under the lapse of time, a cyan image and a magenta image are greatly sensitized by irradiation with safelight. On the contrary, when the pH of the coating is too low, the density of a yellow image largely fluctuates with a change in the time elapsing since the light-sensitive material is exposed until it is developed. Either of the cases poses practical problems.

The term "pH of coating" in the silver halide color photographic light-sensitive material of the present invention means the pH of all photographic layers obtained by applying each coating solution to the support, and it does not always coincides with the pH of the individual coating solution. The pH of coating can be measured by the following method as described in JP-A-61-245153. Specifically;

(1) 0.05 ml of pure water is added dropwise to the surface of a light-sensitive material on the side to which silver halide emulsions are applied. Then;

(2) after it is allowed to stand for 3 minutes, the pH of coating is measured using a surface pH measuring electrode (GS-165F, trade name, manufactured by Towa Denpa). The pH of coating can be adjusted using an acid (e.g., sulfuric acid or citric acid) or an alkali (e.g., sodium hydroxide or potassium oxide), if necessary.

The silver halide color photographic light-sensitive material of the present invention is excellent in uniformity for finished photograph at a laboratory where processing is conducted, in particular excellent in stability of density of white portions regardless of a storage time of the material. Further the silver halide color photographic light-sensitive material of the present invention does not generate static fogging even if the material is subjected to a high-speed exposure. The material can be used suitably, in particular, as a color positive light-sensitive material for movie.

The present invention will be described in more detail based on examples given below, but the present invention is not meant to be limited by these examples.

EXAMPLES

In the following Examples, the terms "part" and "%" are values by mass, unless they are indicated differently in particular.

<Preparation of Sample 101>

[Preparation of Support]A polyethylene terephthalate film was biaxially drawn 3.3 times in each of the length and width directions, and then the resultant was thermally fixed at 240° C. for 10 minutes. Thereafter, both surfaces of the resultant film were subjected to corona discharge treatment, to give a polyethylene terephthalate film (PET film) support having 120 μm in thickness.

[Formation of First Undercoating Layer and Second Undercoating Layer]

Prepared were a coating solution for forming the first undercoating layer and a coating solution for forming the second undercoating layer (referred to as a "coating solution for the first undercoating layer" and a "coating solution for second undercoating layer" hereinafter) each having a composition described below. Subsequently, the coating solution for the first undercoating layer was first applied onto one of the surfaces of the PET film with a bar coater, and the resultant was dried at 180° C. for 30 seconds, to form a first undercoating layer having 0.3 μm in thickness. Furthermore, the coating solution for the second undercoating layer was applied onto the first undercoating layer in the same way, and the resultant was dried at 17° C. for 30 seconds, to form a second undercoating layer having 0.15 μm in thickness. The resultant was in a state that the first and second undercoating layers were laminated in this order on the support.

| <<Coating solution for first undercoating layer>> (total amount: 100.04 mass parts) | |
|---|---|
| Styrene/butadiene copolymer latex (trade name: LX-407C5, manufactured by Nippon Zeon Co., Ltd.; styrene/butadiene = 67/30, and solid content: 40 mass %) | 14.1 parts |
| 2,4-Dichloro-6-hydroxy-s-triazine (solid content: 8 mass %) | 2.5 parts |
| Polystyrene particles (trade name: UFN 1008, manufactured by Nippon Zeon Co., Ltd.; average particle diameter: 2 μm, and solid content: 20 mass %) | 0.04 part |
| Distilled water | 83.4 parts |
| <<Coating solution for second undercoating layer>> (total amount: 99.9 mass parts) | |
| Gelatin (trade name: PHOTOGRAPHIC GELATIN 681 TYPE, manufactured by Nitta Gelatin Inc.; solid content: 10 mass %) | 14.8 parts |
| Acetic acid (solid content: 20%) | 1.0 part |
| The following compound (1) (solid content: 1.5 mass %) | 2.2 parts |
| The following compound (2) illustrated below (solid content: 3.5 mass %): | 0.1 part |
| Methylcellulose (trade name: Metolose 60SH-6, manufactured by Shin-Etsu Chemical Co., Ltd.; solid content: 2 mass %) | 2.3 parts |
| Distilled water | 79.5 parts |

Compound (1)

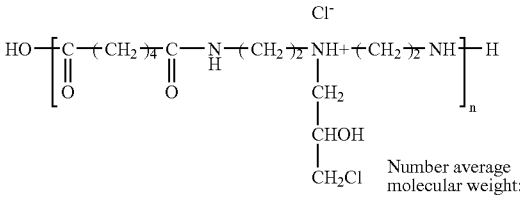

Number average molecular weight: 10000

Compound (2)

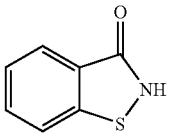

[Formation of Antistatic Layer]

Subsequently, a coating solution for the antistatic layer having the following composition was applied onto the support surface, on which the undercoating layers were not provided, with a bar coater, and the resultant was dried at 180° C. for 30 seconds, to give an antistatic layer having 0.1 μm in thickness.

| <<Coating solution for antistatic layer>> | |
|---|---|
| Polyacrylic resin dispersion in water (trade name: JURYMER ET410, manufactured by Nihon Junyaku Co., Ltd.; solid content: 30 mass %) | 1.9 parts |
| Tin oxide-antimony oxide dispersion (trade name: TDL-1, manufactured by Mitsubishi Materials Corp.; average particle diameter: 0.1 μm, and solid content: 17 mass %) | 7.1 parts |
| Electroconductive polymer (The following compound (3)) | 2.0 parts |
| Carbodiimide compound (trade name: CARBODILITE V02-L2, manufactured by Nisshinbo Industries Inc.; solid content: 8 mass %) | 1.1 parts |
| Surfactant (The following compound (4)) (polyoxyethylene nonyl phenyl ether; solid content: 10 mass %) | 0.6 part |
| Sodium alkylsulfonate (trade name: SANDET BL, manufactured by Sanyo Chemicals Co., Ltd.; solid content: 3 mass %) | 0.6 part |
| Mat agent (trade name: MP-1000, manufactured by Soken Chemical & Engineering Co., Ltd.; average particle diameter: 0.4 μm, and solid content: 5 mass %) | 1.0 part |
| Distilled water | 85.7 parts |

Compound (3)
Electrically conductive polymer

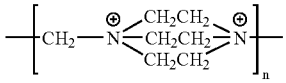

Compound (4)

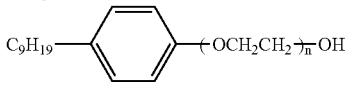

n = 8.5

[Formation of Protective Layer]

Subsequently, a coating solution for a protective layer having the following composition was applied onto the antistatic layer with a bar coater, and the resultant was dried at 170° C. for 30 seconds, to form a protective layer having 0.03 μm in thickness.

| <<Coating solution for protective layer>> | |
|---|---|
| Polyolefin ionomer (trade name: CHEMIPEARL S-120, manufactured by Mitsui Chemicals, Inc.; solid content: 27 mass %) | 2.3 parts |
| Colloidal silica (trade name: SNOWTEX CL, manufactured by Nissan Chemical Industries, Ltd.; solid content: 20 mass %) | 1.5 parts |
| Epoxy compound (trade name: DENACOL EX-614B, manufactured by Nagase Chemicals, Ltd.; solid content: 1 mass %) | 22.2 parts |
| Thickener (The following compound (5)) (polystyrene sulfonic acid salt; solid content: 3 mass %) | 1.1 parts |
| Sodium alkylsulfonate (trade name: SANDET BL, manufactured by Sanyo Chemicals Co., Ltd.; solid content: 10 mass %) | 0.8 part |
| Surfactant (polyoxyethylene octyl phenyl ether/glycidol adduct; solid content: 4 mass %) | 1.9 parts |
| Distilled water | 70.2 parts |

Compound (5)

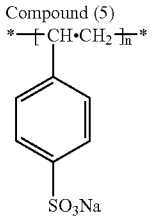

Number average molecular weight: 660000

[Preparation of Silver Halide Emulsions]

—Preparation of Blue-sensitive Silver Halide Emulsions—

Large-size Emulsion (BO-01) (Cube, Grain Size 0.71 μm, Grain Size Distribution 0.09, Halogen Composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $4\times10^{-7}$ mol/mol Ag. To this emulsion were added the sensitizing dyes (A') to (C') represented by the structural formulae which will be shown later, as follows.

Blue-sensitive sensitizing dye (A'): $3.5\times10^{-5}$ mol/mol Ag
Blue-sensitive sensitizing dye (B'): $1.9\times10^{-4}$ mol/mol Ag
Blue-sensitive sensitizing dye (C'): $1.8\times10^{-5}$ mol/mol Ag Further, the emulsion was optimally gold-sulfur sensitized using chloroauric acid and triethylthiourea.

Middle-size Emulsion (BM-01) (Cube, Grain Size 0.52 μm, Grain Size Distribution 0.09, Halogen Composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $6\times10^{-7}$ mol/mol Ag. To this emulsion were added the sensitizing dyes (A') to (C') represented by the structural formulae which will be shown later, as follows.

Blue-sensitive sensitizing dye (A'): $6.9\times10^{-5}$ mol/mol Ag
Blue-sensitive sensitizing dye (B'): $2.3\times10^{-4}$ mol/mol Ag
Blue-sensitive sensitizing dye (C'): $2.7\times10^{-5}$ mol/mol Ag Further, the emulsion was optimally gold-sulfur sensitized using chloroauric acid and triethylthiourea.

Small-size Emulsion (BU-01) (Cube, Grain Size 0.31 μm, Grain Size Distribution 0.08, Halogen Composition Br/Cl=3/97)

This emulsion was prepared in the same manner as BM-01, except that, in the preparation of BM-01 emulsion, the grain formation temperature was lowered.

The sensitizing dyes (A') to (C') represented by the structural formulae which will be shown later, were added as follows.

Blue-sensitive sensitizing dye (A'): $8.5\times10^{-4}$ mol/mol Ag
Blue-sensitive sensitizing dye (B'): $4.1\times10^{-4}$ mol/mol Ag
Blue-sensitive sensitizing dye (C'): $3.7\times10^{-5}$ mol/mol Ag —Preparation of Red-Sensitive Silver Halide Emulsions—

Large-size Emulsion (RO-01) (Cube, Grain Size 0.23 μm, Grain Size Distribution 0.11, Halogen Composition Br/Cl=25/75)

This emulsion was prepared by addition of an aqueous silver nitrate solution and an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (D') to (F') represented by the structural formulae which will be shown later, as follows, to effect spectral sensitization.

Red-sensitive sensitizing dye (D'): $4.5\times10^{-5}$ mol/mol Ag
Red-sensitive sensitizing dye (E'): $0.2\times10^{-5}$ mol/mol Ag
Red-sensitive sensitizing dye (F'): $0.2\times10^{-5}$ mol/mol Ag Furthermore, this emulsion was optimally gold-sulfur sensitized with chloroauric acid and triethylthiourea, and thereafter Cpd-71 represented by the structural formula which will be shown later, was added in an amount of $9.0\times10^{-4}$ mol per mol of silver halide.

Middle-size Emulsion (RM-01) (Cube, Grain Size 0.174 μm, Grain Size Distribution 0.12, Halogen Composition Br/Cl=25/75)

This emulsion was prepared in the same manner as RO-01, except that, in the preparation of RO-01 emulsion, the grain formation temperature was changed, and the sensitizing dyes (D') to (F') represented by the structural formulae which will be shown later, were added as follows.

Red-sensitive sensitizing dye (D'): $7.0\times10^{-5}$ mol/mol Ag
Red-sensitive sensitizing dye (E'): $1.0\times10^{-5}$ mol/mol Ag
Red-sensitive sensitizing dye (F'): $0.4\times10^{-5}$ mol/mol Ag Small-size Emulsion (RU-01) (Cube, Grain Size 0.121 μm, Grain Size Distribution 0.13, Halogen Composition Br/Cl=25/75)

This emulsion was prepared in the same manner as RO-01, except that, in the preparation of RO-01 emulsion, the grain formation temperature was changed, and the sensitizing dyes (D') to (F') represented by the structural formulae which will be shown later, were added as follows.

Red-sensitive sensitizing dye (D'): $8.9\times10^{-5}$ mol/mol Ag
Red-sensitive sensitizing dye (E'): $1.2\times10^{-5}$ mol/mol Ag
Red-sensitive sensitizing dye (F'): $0.5\times10^{-5}$ mol/mol Ag —Preparation of Green-sensitive Silver Halide Emulsions—

Large-size Emulsion (GO-01) (Cube, Grain Size 0.20 μm, Grain Size Distribution 0.11, Halogen Composition Br/Cl=3/97)

This emulsion was prepared by addition of an aqueous silver nitrate solution, an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (G') to (J') represented by the structural formulae which will be shown later, as follows, to effect spectral sensitization.

Green-sensitive sensitizing dye (G'): $2.8\times10^{-4}$ mol/mol Ag
Green-sensitive sensitizing dye (H'): $0.8\times10^{-4}$ mol/mol Ag
Green-sensitive sensitizing dye (I'): $1.2\times10^{-4}$ mol/mol Ag
Green-sensitive sensitizing dye (J'): $1.2\times10^{4}$ mol/mol Ag Further, the emulsion was optimally gold-sulfur sensitized using chloroauric acid and triethylthiourea.

Middle-size Emulsion (GM-01) (Cube, Grain Size 0.146 μm, Grain Size Distribution 0.12, Halogen Composition Br/Cl=3/97)

This emulsion was prepared in the same manner as GO-01, except that, in the preparation of GO-01 emulsion, the grain formation temperature was changed, and the sensitizing dyes (G') to (J') represented by the structural formulae which will be shown later, were added as follows.

Green-sensitive sensitizing dye (G'): $3.8\times10^{-4}$ mol/mol Ag
Green-sensitive sensitizing dye (H'): $1.3\times10^{-4}$ mol/mol Ag
Green-sensitive sensitizing dye (I'): $1.4\times10^{-4}$ mol/mol Ag
Green-sensitive sensitizing dye (J'): $1.2\times10^{-4}$ mol/mol Ag Small-size Emulsion (GU-01) (Cube, Grain Size 0.102 μm, Grain Size distribution 0.10, Halogen Composition Br/Cl=3/97)

This emulsion was prepared in the same manner as GO-01, except that, in the preparation of GO-01 emulsion, the grain formation temperature was changed, and the sensitizing dyes (G') to (J') represented by the structural formulae which will be shown later, were added as follows.

Green-sensitive sensitizing dye (G'): $5.1\times10^{-4}$ mol/mol Ag
Green-sensitive sensitizing dye (H'): $1.7\times10^{-4}$ mol/mol Ag
Green-sensitive sensitizing dye (I'): $1.9\times10^{-4}$ mol/mol Ag
Green-sensitive sensitizing dye (J'): $1.2\times10^{-4}$ mol/mol Ag Sensitizing dye (A')

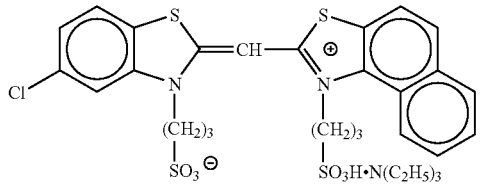

Sensitizing dye (B')

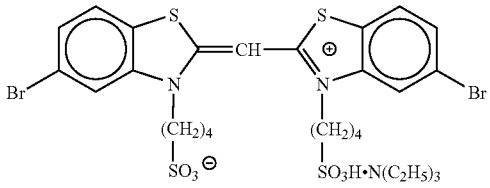

Sensitizing dye (C')

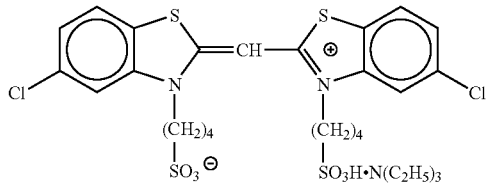

Sensitizing dye (D')

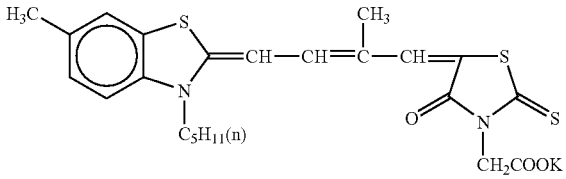

-continued

Sensitizing dye (E′)

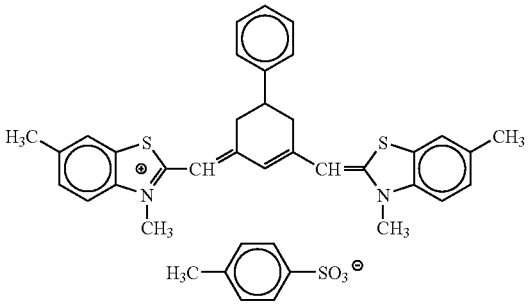

Sensitizing dye (F′)

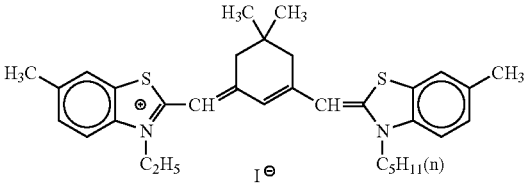

Sensitizing dye (G′)

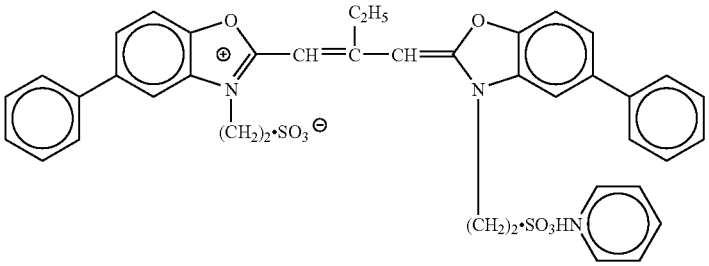

Sensitizing dye (H′)

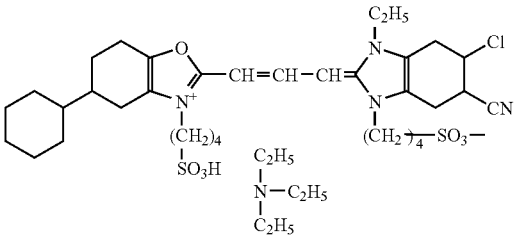

Sensitizing dye (I′)

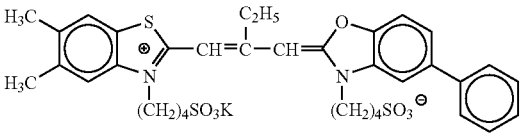

Sensitizing dye (J′)

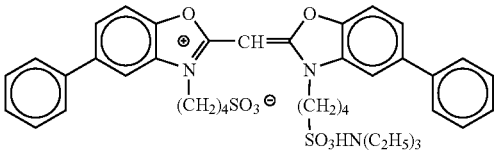

(Cpd-71)

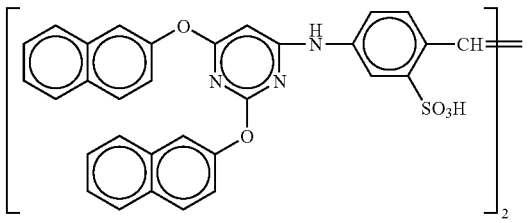

[Preparation of Solid Fine-Particle Dispersions A and B of Dyes]

A methanol wet cake of the compound (HD-1; Exemplified compound (IV-1)) was weighed such that the net amount of the compound was 240 g, and 48 g of the following compound (Pm-1) as a dispersing aid was weighed. To the compounds was added water such that the total amount was 4000 g. The mixture was crushed at a discharge rate of 0.5 l/min and a peripheral velocity of 10 m/s for 2 hours by using "a flow system sand grinder mill (UVM-2)" (trade name, manufactured by AIMEX K.K.) filled with 1.7 l of zirconia beads (diameter: 0.5 mm). Then, the dispersion was diluted such that the concentration of the compound was 3 mass %, and Compound (Pm-1) having the below shown structure was added in an amount of 3% in terms of mass ratio to the dye (this dispersion will be referred to as Dispersion A). The average particle size of this dispersion was 0.45 μm. Further, a dispersion, which contained 5 mass % of the compound (HD-2; Exemplified compound (II-25), was prepared in the same manner as above (this will be referred to as Dispersion B).

(HD-1)

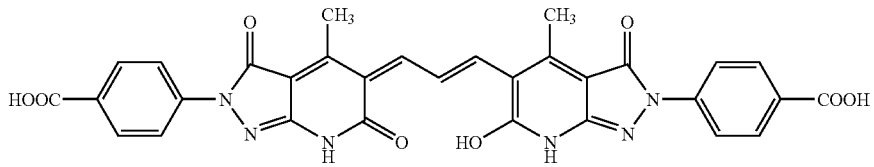

(HD-2)

Pm-1

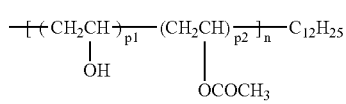

$P_1$ = 88 mol %
$P_2$ = 12 mol %
Polymerization degree 300

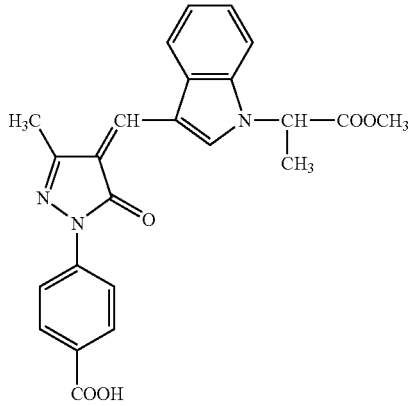

[Preparation of Sample 101]

Each layer having the composition shown below was applied to the support by multilayer-coating, thereby producing a multilayer color photographic light-sensitive material as Sample 101.

—Preparation of a Coating Solution for a Sixth Layer—

75.0 g of a magenta coupler (ExM'), 1.5 g of an additive (Cpd-49), 0.1 g of an additive (Cpd-51) and 2.3 g of an additive (Cpd-55) were dissolved in 15 g of a solvent (Solv-21) and 80 ml of ethyl acetate. The solution was emulsified and dispersed in 1000 g of an aqueous 10% gelatin solution containing 20 ml of 10% solution of an additive (Cpd-52), to prepare an emulsified dispersion M. Using the above-mentioned silver chlorobromide emulsions GO-01, GM-01 and GU-01, the above emulsified dispersion M and the silver chlorobromide emulsion were mixed and dissolved, to prepare a coating solution for a sixth layer such that the solution had the following composition.

Coating solutions for a first layer to a fifth layer and a seventh layer were also prepared in the same manner as the coating solution for a sixth layer.

—Layer Constitution—

The composition of each layer is shown below. The numerals show the amount (g/m$^2$) to be applied. As the amount of the silver halide emulsion, an amount converted into that of silver is shown. As a gelatin hardener, a sodium salt of 1-oxy-3,5-dichloro-s-triazine was used.

(Layer Constitution of Sample 101)

Support

Polyethylene terephthalate film described above

| | |
|---|---|
| First layer (halation preventive layer (non-light-sensitive hydrophilic colloid layer)) | |
| Gelatin | 1.02 |
| The above Dispersion A (in terms of coating amount of dye) | 0.11 |
| The above Dispersion B (in terms of coating amount of dye) | 0.06 |
| Second layer (blue light-sensitive silver halide emulsion layer) | |
| A mixture of silver chlorobromide emulsions BO-01, BM-01, and BU-01, mixed in a ratio of 3:1:6 (mol ratio of silver) | 0.54 |
| Gelatin | 2.71 |
| Yellow coupler (ExY') | 1.19 |
| (Cpd-41) | 0.0006 |
| (Cpd-42) | 0.01 |
| (Cpd-43) | 0.04 |
| (Cpd-44) | 0.006 |
| (Cpd-45) | 0.017 |
| (Cpd-46) | 0.002 |
| (Cpd-52) | 0.07 |
| (Cpd-54) | 0.08 |
| (Cpd-63) | 0.02 |
| Solvent (Solv-21) | 0.26 |
| Third Layer (Color-Mixing Inhibiting Layer) | |
| Gelatin | 0.56 |
| (Cpd-49) | 0.02 |
| (Cpd-43) | 0.05 |
| (Cpd-52) | 0.01 |
| (Cpd-53) | 0.005 |
| (Cpd-61) | 0.02 |
| (Cpd-62) | 0.05 |
| Solvent (Solv-21) | 0.05 |
| Solvent (Solv-23) | 0.04 |
| Solvent (Solv-24) | 0.001 |

-continued

| Fourth layer (red light-sensitive silver halide emulsion layer) | |
|---|---|
| A mixture of silver chlorobromide emulsions RO-01, RM-01, and RU-01, mixed in a ratio of 2:2:6 (mol ratio of silver) | 0.38 |
| Gelatin | 2.79 |
| Cyan coupler (ExC') | 0.75 |
| (Cpd-47) | 0.06 |
| (Cpd-48) | 0.06 |
| (Cpd-50) | 0.03 |
| (Cpd-52) | 0.04 |
| (Cpd-53) | 0.03 |
| (Cpd-55) | 0.03 |
| (Cpd-57) | 0.05 |
| (Cpd-58) | 0.007 |
| (Cpd-60) | 0.02 |
| Solvent (Solv-21) | 0.51 |
| Solvent (Solv-22) | 0.28 |
| Solvent (Solv-23) | 0.03 |
| Fifth Layer (Color-Mixing Inhibiting Layer) | |
| Gelatin | 0.56 |
| (Cpd-49) | 0.02 |
| (Cpd-43) | 0.05 |
| (Cpd-52) | 0.01 |
| (Cpd-53) | 0.005 |
| (Cpd-62) | 0.05 |
| (Cpd-64) | 0.002 |
| Solvent (Solv-21) | 0.05 |
| Solvent (Solv-23) | 0.04 |
| Solvent (Solv-24) | 0.001 |
| Sixth Layer (Green Light-Sensitive silver halide Emulsion Layer) | |
| A mixture of silver chlorobromide emulsions GO-01, GM-01, GU-01, mixed in a ratio of 1:3:6 (mol ratio of silver) | 0.54 |
| Gelatin | 1.66 |
| Magenta coupler (ExM') | 0.73 |
| (Cpd-49) | 0.013 |
| (Cpd-51) | 0.001 |
| (Cpd-52) | 0.02 |
| (Cpd-55) | 0.02 |
| Solvent (Solv-21) | 0.15 |
| Seventh Layer (Protective Layer) | |
| Gelatin | 0.97 |
| Acrylic resin (av. particle diameter, 2 μm) | 0.002 |
| (Cpd-55) | 0.03 |
| (Cpd-56) | 0.08 |
| (Cpd-59) | 0.001 |

Herein, the compounds used are shown below.

ExY'

(1)

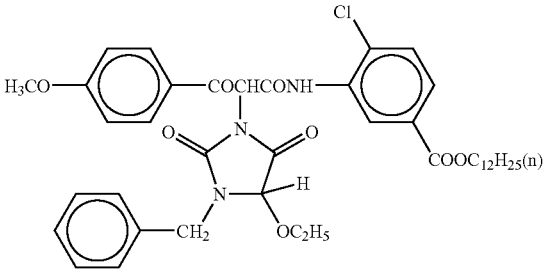

-continued (2)

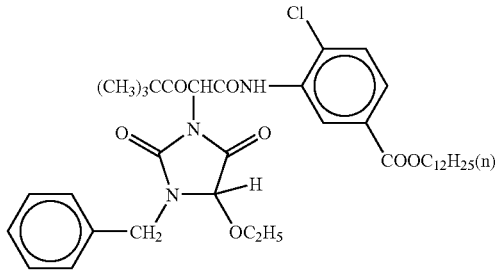

(3)

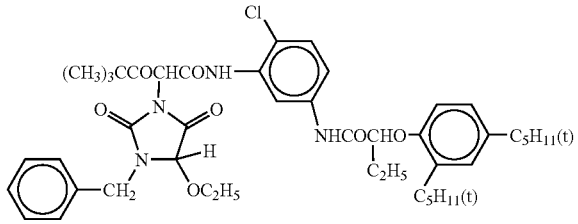

A mixture in 80:10:10 (molar ratio) of (1), (2), and (3)

ExC'

(1)

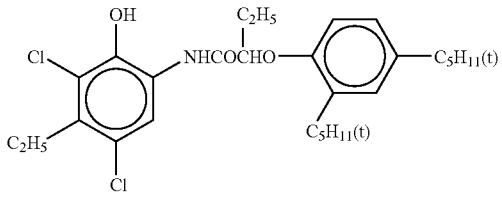

(2)

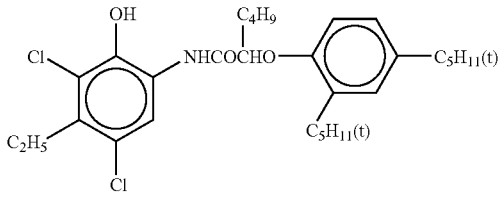

-continued
(3)
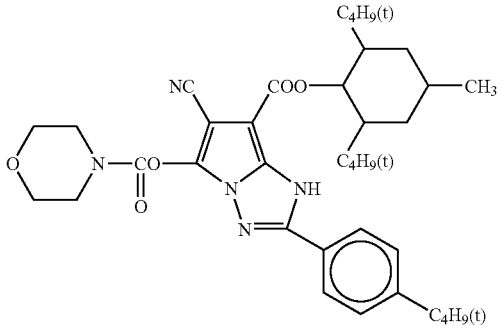
(4)
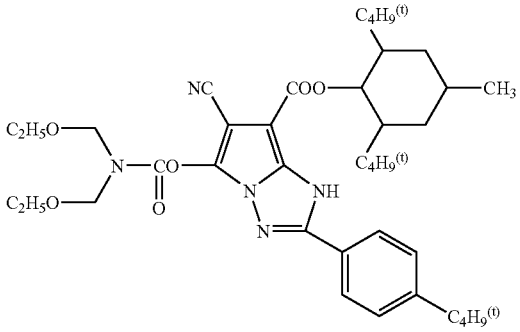
A mixture in 40:40:10:10 (molar ratio) of (1), (2), (3), and (4)
ExM'
(1)
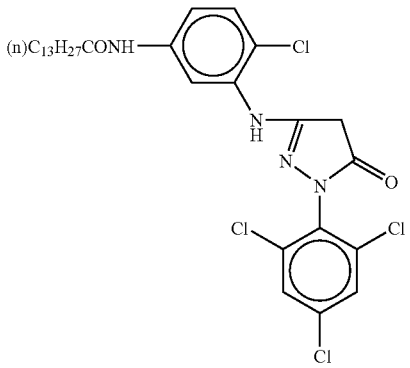
-continued
(2)
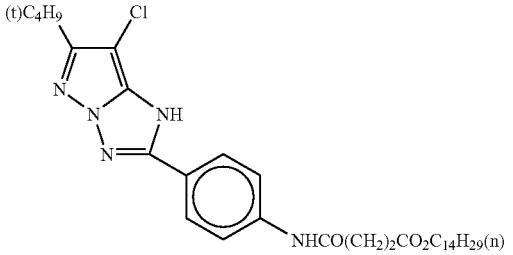
(3)
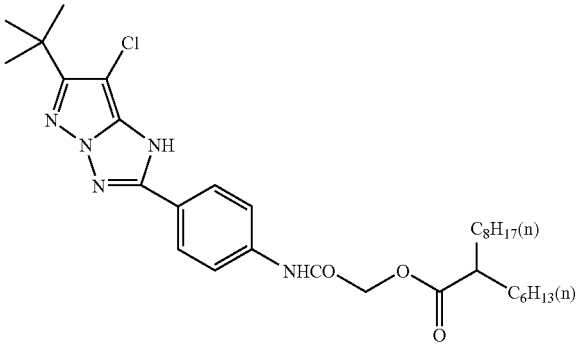
A mixture in 90:5:5 (molar ratio) of (1), (2), and (3)
(Cpd-41)
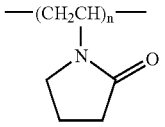
(Cpd-42)
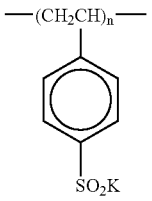
(Cpd-43)
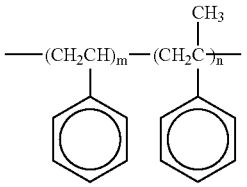
Number-average molecular weight 600 m/n = 10/90

-continued
(Cpd-44)
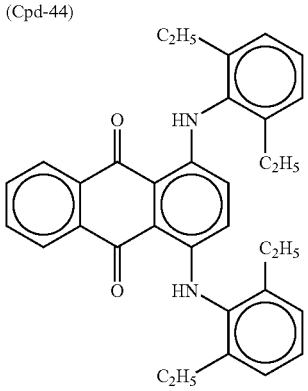
(Cpd-45)
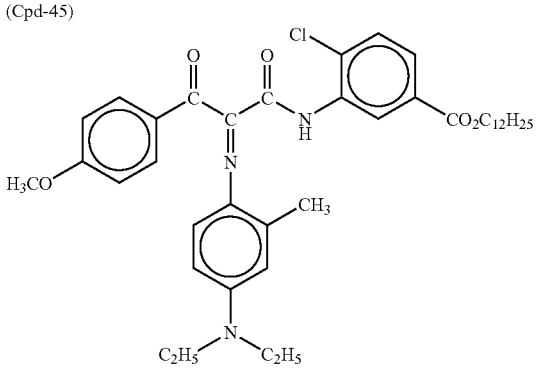
(Cpd-46)
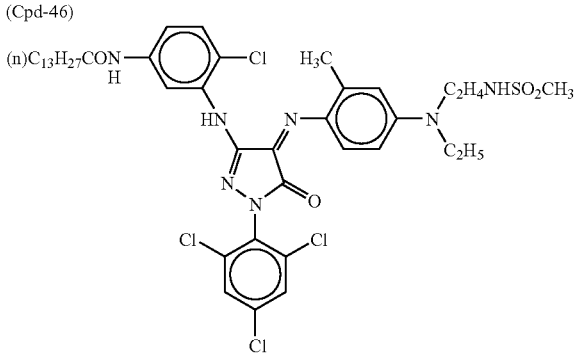
(Cpd-47)
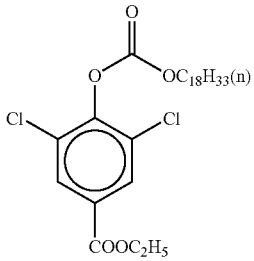
(Cpd-48)
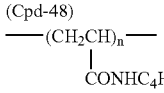
Number average molecular weight about 60,000
-continued
(Cpd-49)
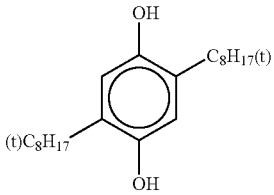
(Cpd-50)
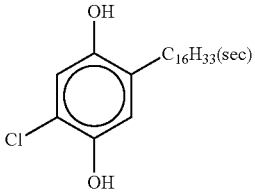
(Cpd-51)
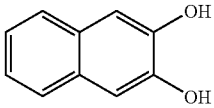
(Cpd-52)
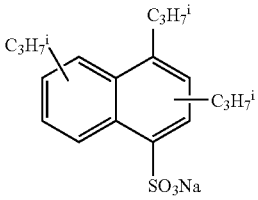
(Cpd-53)
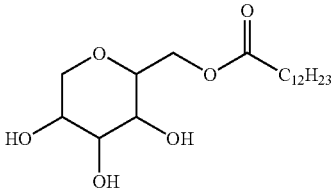
(Cpd-54)
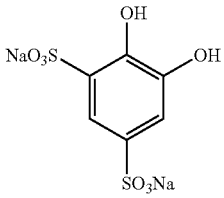
(Cpd-55)
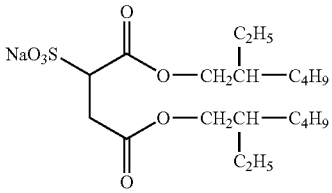
(Cpd-56)
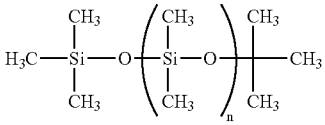

-continued (Cpd-57)

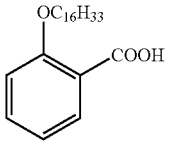

(Cpd-58)

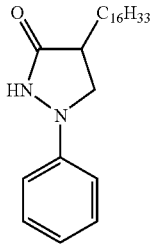

(Cpd-59)

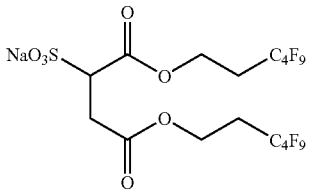

(Cpd-60)

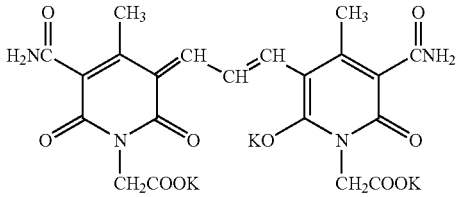

(Cpd-61)

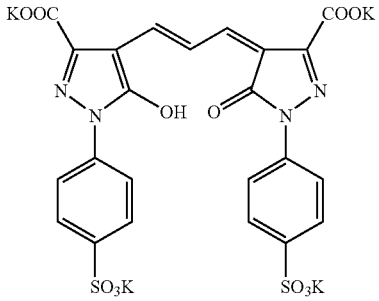

(Cpd-62)

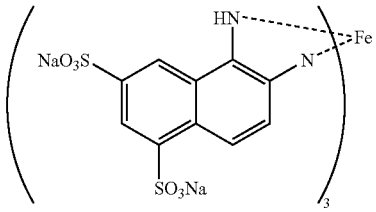

-continued (Cpd-63)

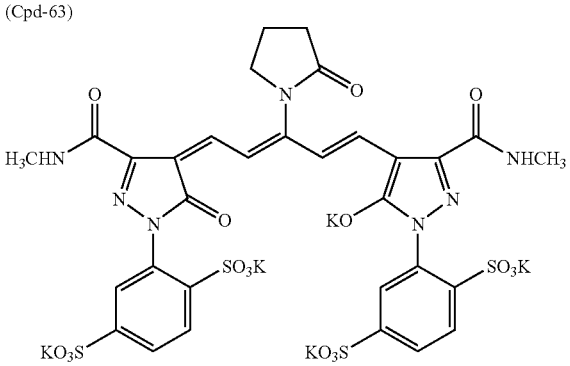

(Cpd-64)

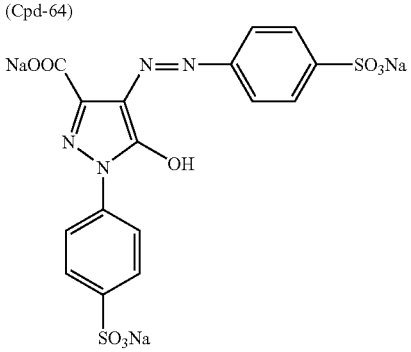

(Solv-21)

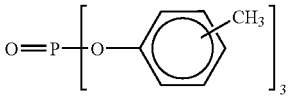

(Solv-22)

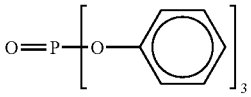

(Solv-23)

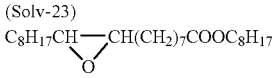

(Solv-24)

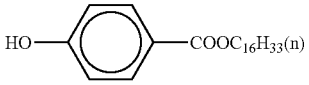

In the above manner, Sample 101 was prepared.

<Formation of a Sample 100>

The first layer was removed from the Sample 101, and a resin back layer was given to the opposite surface of the support so as to form Sample 100.

<Formation of Samples 102 to 113>

Samples 102 to 113 were prepared in the same manner as in the formation of the light-sensitive material 101, except that the coating amount of the tin oxide-antimony oxide dispersion contained in the antistatic layer was changed to each amount shown in Table 1, and/or that the compound shown in Table 1, which is represented by formula (AS), was incorporated into the same layer in an amount shown in Table 1.

<Tests and Evaluations>

About each of the Samples 100 to 113, the following tests were made in order to evaluate the color tone in white portions and the electrically charging characteristic.

—White Portions Evaluation—

Each of the samples unexposed to any light was processed in accordance with an ECP-2 process published by Eastman Kodak Co. A device, X-rite 310TR (trade name) manufactured by X-rite Co. was used to measure the densities of 5 portions each exhibiting a B density in the processed sample. From the densities, the average thereof was calculated and defined as Ymin. As this value is larger, the density of the white portions deteriorates.

—Electrically Charging Characteristic Evaluation—

About each of the resultant samples 100 to 113, the generation of static marks and the occurrence of an electrostatic trouble in a horizontal platter projector were observed.

(1) Generation of Static Marks

Each of the samples was worked into a long film having a width of 35 mm, and was exposed to light so as to give the following density value measured with the X-rite after the sample was developed: (R, G, B)=(1.0, 1.0, 1.0). Under a condition of 25° C. and a relative humidity of 15%, the sample was transported by means of a printer at a rate of 2500 ft/minute in a dark room, and then developed with an automatic developing device. The resulting sample was observed with the naked eye and evaluated based on the following criteria:

○: No static mark was generated.

Δ: Static marks were generated in some portions.

x: Many static marks were generated.

xx: Static marks were continuously generated to form a linear mark.

(2) Occurrence of an Electrostatic Trouble in a Horizontal Platter Projector

Were transported 6000 ft of each of the developed samples by means of a horizontal platter projector (trade name: LP-270, manufactured by SPECO Systems & Products Engineering Co.), and then the sample was evaluated based on the following criteria:

○: No trouble was caused.

Δ: The film was sometime transported in a state that portions thereof adhered to each other.

x: The film was frequently transported in a state that portions thereof adhered to each other.

xx: The film was transported in a state that portions thereof adhered to each other so that the film clung onto the center of the platter.

(3) Electrically Charging Characteristic Value Evaluation

In accordance with the method described in the present specification, SR1, that is the logarithm of the surface resistance value before the development, and SR2, that is the logarithm of the surface resistance value after the development, were measured.

—Developing Solution Stain Evaluation—

Each of the samples was worked into a long film having a width of 35 mm, and was exposed to light so as to give the following density value measured with the X-rite after the sample was developed: (R, G, B)=(1.0, 1.0, 1.0). The sample was transported by means of a printer in a dark room, and then developed with an automatic developing device. Thereafter, the developing solution bath was observed with the naked eye and evaluated based on the following criteria:

○: The developing solution did not muddy into black.

x: The solution muddied into black.

The evaluation results are shown in Table 1.

TABLE 1

| Sample No. | Tin oxide-antimony oxide dispersion coated amount (mg/m$^2$) | Coated compound AS | AS coated amount (mg/m$^2$) | SR1 | SR2 | SR2 − SR1 | Static marks | Film projector trouble | Processing stain | Ymin | Remarks |
|---|---|---|---|---|---|---|---|---|---|---|---|
| 100 | 0 | — | — | 8.8 | 10.5 | 1.7 | ○ | ○ | x | 0.83 | Comparative example |
| 101 | 110 | — | — | 10.5 | 10.2 | −0.3 | x | ○ | ○ | 0.12 | Comparative example |
| 102 | 150 | — | — | 9.7 | 9.7 | 0.0 | Δ | x | ○ | 0.13 | Comparative example |
| 103 | 200 | — | — | 9.1 | 9.4 | 0.3 | ○ | Δ | ○ | 0.15 | This invention |
| 104 | 60 | — | — | 11.5 | 11.7 | 0.2 | x | ○ | ○ | 0.10 | Comparative example |
| 105 | 60 | AS-4 | 20 | 10.5 | 11.8 | 1.3 | ○ | ○ | ○ | 0.11 | This invention |
| 106 | 110 | AS-4 | 10 | 9.7 | 10.1 | 0.4 | ○ | ○ | ○ | 0.12 | This invention |
| 107 | 110 | AS-5 | 20 | 9.8 | 10.1 | 0.3 | ○ | ○ | ○ | 0.1 | This invention |
| 108 | 110 | AS-6 | 20 | 9.7 | 10.2 | 0.5 | ○ | ○ | ○ | 0.12 | This invention |
| 109 | 110 | AS-1 | 20 | 9.9 | 10.3 | 0.4 | ○ | ○ | ○ | 0.11 | This invention |
| 110 | 40 | — | — | 12.8 | 13.1 | 0.3 | x | ○ | ○ | 0.12 | Comparative example |
| 111 | 0 | — | — | 15.6 | 15.9 | 0.3 | xx | ○ | ○ | 0.12 | Comparative example |
| 112 | 220 | — | — | 8.9 | 9.1 | 0.2 | ○ | x | ○ | 0.15 | Comparative example |
| 113 | 510 | — | — | 6.2 | 6.3 | 0.1 | ○ | xx | ○ | 0.16 | Comparative example |

As is evident from the results shown in Table 1, in the sample 100, wherein the first layer (i.e., the non-light-sensitive hydrophilic colloid layer containing a solid particle dispersion of a dye represented by formula (I)) was changed to a resin back layer not containing the dye, black muddy stain was generated in the processing solution, and the change (Ymin) in the density of the white portions was also large. In the samples 101, 102, 104 and 110 to 113, wherein the surface resistance value of their sample surface at the support-rear-face side did not satisfy the expressions (S) or (T), static marks were generated and/or an electrostatic trouble in the film projector was caused when the high-speed exposure was performed.

On the other hand, in the samples 103 and 105 to 109, wherein their non-light-sensitive hydrophilic colloidal layer contained a solid particle dispersion of a dye represented by formula (I) and further the surface resistance value of their sample surface at the support-rear-face side satisfied the expressions (S) and (T), it was possible to prevent the generation of static marks and the occurrence of a electrostatic trouble. In particular, in the samples 105 to 109, wherein a compound represented by formula (AS) was used, static marks were not generated at all, and an electrostatic trouble in the film projector was not caused at all, either.

Having described our invention as related to the present embodiments, it is our intention that the invention not be limited by any of the details of the description, unless otherwise specified, but rather be construed broadly within its spirit and scope as set out in the accompanying claims.

We claim:

1. A silver halide color photographic light-sensitive material for movie, comprising, on a side of a transmission support, at least one yellow-color-forming light-sensitive silver halide emulsion layer, at least one cyan-color-forming light-sensitive silver halide emulsion layer, at least one magenta-color-forming light-sensitive silver halide emulsion layer and at least one non-light-sensitive hydrophilic colloidal layer, wherein the non-light-sensitive hydrophilic colloidal layer comprises a solid fine-particle dispersion of a dye represented by formula (I) shown below; and wherein a surface resistance value of a surface of the material opposite to the side where the silver halide emulsion layers are provided, satisfies expression (S) and expression (T) described below:

$$D-(X)_y \qquad \text{Formula (I)}$$

wherein, in formula (I), D represents a group to give a compound having a chromophore, X represents a dissociable hydrogen or a group having a dissociable hydrogen, and y represents an integer of 1 to 7; and $$0.3 \leqq (SR2-SR1) \leqq 3.0 \qquad \text{Expression (S)}$$

$$9.0 \leqq SR1 \leqq 12.7 \qquad \text{Expression (T)}$$

wherein, in expression (S) and expression (T), SR1 represents the logarithm of the surface resistance value R1 before the material is subjected to a color developing treatment, and SR2 represents the logarithm of the surface resistance value R2 after the material is subjected to the color developing treatment; and wherein at least one layer provided on a surface of the support opposite to the side where the silver halide emulsion layers are provided comprises a compound represented by Formula (AS) shown below:

Formula (AS)

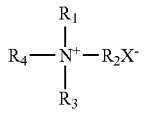

wherein $R_1$ to $R_4$ each independently represent an alkyl group having 1 to 4 carbon atoms, and X represents a halogen or a hydroxyl group.

2. The silver halide color photographic light-sensitive material for movie according to claim 1, wherein the transmission type transmission support is a polyester support; and wherein an electroconductive antistatic layer and a protective layer are provided, in this order, on a surface of the support opposite to the side where the silver halide emulsion layers are provided.

3. The silver halide color photographic light-sensitive material for movie according to claim 2, wherein the electroconductive antistatic layer comprises metal oxide particles; and wherein the metal oxide particles are made of at least one metal oxide selected from the group consisting of ZnO, $TiO_2$, $SnO_2$, $Al_2O_3$, $In_2O_3$, MgO, complex metal oxides of these metal oxides, and metal oxides containing at least one of these metal oxides and a different atom.

4. The silver halide color photographic light-sensitive material for movie according to claim 3, wherein the content of the metal oxide particles in the antistatic layer is from 50 $mg/m^2$ to 500 $mg/m^2$.

5. The silver halide color photographic light-sensitive material for movie according to claim 1, wherein the SR1 is in the range of from 9.5 to 11.0.

6. The silver halide color photographic light-sensitive material for movie according to claim 1, wherein the SR2 is in the range of from 9.3 to 14.5.

7. The silver halide color photographic light-sensitive material for movie according to claim 1, wherein the (SR2−SR1) is in the range of from 0.5 to 1.5.

8. The silver halide color photographic light-sensitive material for movie according to claim 1, wherein the compound represented by formula (AS) is a compound selected from the group consisting of $(CH_3)_4N^+\cdot Cl^-$, $(CH_3)_4N^+\cdot Br^-$, $(CH_3)_4N^+\cdot OH^-$, $(C_2H_5)_4N^+\cdot Cl^-$, $(C_2H_5)_4N^+\cdot Br^-$, $(C_2\ _{Cl}^-$, $(C_3H_7)_4N^+\cdot Br^-$, $(C_3H_7)_4N^+\cdot OH^-$, $(C_4H_9)_4N^+\cdot Cl^-$, $(C_4H_9)_4N^+\cdot Br^-$, and $(C_4H_9)_4N^+OH^-$.

* * * * *